US009593559B2

(12) United States Patent
Yeh et al.

(10) Patent No.: US 9,593,559 B2
(45) **Date of Patent: *Mar. 14, 2017**

(54) FLUID FILTERING DEVICE FOR A WELLBORE AND METHOD FOR COMPLETING A WELLBORE

(75) Inventors: Charles S. Yeh, Spring, TX (US); Tracy J. Moffett, Sugar Land, TX (US); Ted A. Long, Spring, TX (US); Andrey A. Troshko, Pearland, TX (US); Michael D. Barry, The Woodlands, TX (US); Michael T. Hecker, Tomball, TX (US); David A. Howell, Houston, TX (US); Annabel Green, Lumsden Huntly (GB); Stephen McNamee, Houston, TX (US); Rodney S. Royer, Spring, TX (US); Robert F. Hodge, Cypress, TX (US); Peter Olenick, Spring, TX (US); Henry Nguyen, Richmond, TX (US); William Barry Fisher, Tomball, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 437 days.

This patent is subject to a terminal disclaimer.

(21) Appl. No.: 14/347,552

(22) PCT Filed: Aug. 23, 2012

(86) PCT No.: PCT/US2012/052085

§ 371 (c)(1),
(2), (4) Date: Mar. 26, 2014

(87) PCT Pub. No.: WO2013/055451

PCT Pub. Date: Apr. 18, 2013

(65) Prior Publication Data

US 2014/0231083 A1 Aug. 21, 2014

Related U.S. Application Data

(60) Provisional application No. 61/546,400, filed on Oct. 12, 2011.

(51) Int. Cl.
*E21B 43/08* (2006.01)
*E21B 43/02* (2006.01)
(Continued)

(52) U.S. Cl.
CPC ..... *E21B 43/02* (2013.01); *E21B 43/04* (2013.01); *E21B 43/08* (2013.01); *E21B 43/14* (2013.01)

(58) Field of Classification Search
CPC combination set(s) only.
See application file for complete search history.

(56) References Cited

U.S. PATENT DOCUMENTS 1,473,644 A 11/1923 Rodrigo
1,594,788 A 1/1925 McLaughlin et al.
(Continued)

FOREIGN PATENT DOCUMENTS

EP 0617195 9/1994
WO WO 2013/055451 4/2013

OTHER PUBLICATIONS

Yeh, C.S. et al., "A Self-Mitigating Sand Control Screen", SPE 121844, SPE European Formation Damage Conference, May 27-29, 2009, 6 pages, Scheveningen, The Netherlands.
(Continued)

*Primary Examiner* — David Andrews
*Assistant Examiner* — Ronald Runyan
(74) *Attorney, Agent, or Firm* — ExxonMobil Upstream Research Company-Law Department

(57) ABSTRACT

A sand control device for restricting flow of particles from a subsurface formation into a tubular body within a well-
(Continued)

bore, the device being divided into compartments along its length, each compartment comprises a base pipe. The base pipe defines an elongated tubular body having a permeable section and an impermeable section within each compartment, also comprising a first filtering conduit and a second filtering conduit. The filtering conduits are arranged so that the first filtering conduit is adjacent to the non-permeable section of the base pipe, while the second filtering conduit is adjacent to the permeable section of the base pipe.

40 Claims, 11 Drawing Sheets

(51) Int. Cl.
*E21B 43/04* (2006.01)
*E21B 43/14* (2006.01)

(56) References Cited

U.S. PATENT DOCUMENTS 1,620,412 A 3/1927 Tweeddale
2,681,111 A 6/1954 Thompson
3,173,488 A 3/1965 Rensvold
3,357,564 A 12/1967 Medford, Jr. et al.
3,556,219 A 1/1971 Meldau
3,712,373 A * 1/1973 Bearden ..... B01D 39/10 166/232
4,064,938 A 12/1977 Fast
4,428,428 A 1/1984 Smyrl et al.
4,657,079 A 4/1987 Nagaoka
4,771,829 A 9/1988 Sparlin
4,818,403 A 4/1989 Nagaoka
4,945,991 A 8/1990 Jones
4,977,958 A 12/1990 Miller
5,004,049 A 4/1991 Artebury
5,069,279 A 12/1991 Nagaoka
5,076,359 A 12/1991 Yeh
5,082,052 A 1/1992 Jones et al.
5,083,614 A 1/1992 Branch
5,113,935 A 5/1992 Jones et al.
5,115,864 A 5/1992 Gaidry et al.
5,161,613 A 11/1992 Jones
5,161,618 A 11/1992 Jones et al.
5,165,476 A 11/1992 Jones
5,197,543 A * 3/1993 Coulter ..... E21B 33/13 166/281
5,209,296 A 5/1993 Donlon
5,222,556 A 6/1993 Donlon
5,246,158 A 9/1993 Nagaoka et al.
5,307,984 A 5/1994 Nagaoka et al.
5,311,942 A 5/1994 Nagaoka
5,318,119 A 6/1994 Lowry et al.
5,332,045 A 7/1994 Ross et al.
5,333,688 A 8/1994 Jones et al.
5,333,689 A 8/1994 Jones et al.
5,341,880 A 8/1994 Thorstensen et al.
5,355,949 A 10/1994 Sparlin et al.
5,390,966 A 2/1995 Cox et al.
5,392,850 A 2/1995 Cornette et al.
5,396,954 A 3/1995 Brooks
5,404,945 A 4/1995 Head et al.
5,415,202 A 5/1995 Shiffler et al.
5,417,284 A 5/1995 Jones
5,419,394 A 5/1995 Jones
5,435,391 A 7/1995 Jones
5,450,898 A 9/1995 Sparlin et al.
5,476,143 A 12/1995 Sparlin et al.
5,505,260 A 4/1996 Andersen et al.
5,515,915 A 5/1996 Jones et al.
5,560,427 A 10/1996 Jones
5,588,487 A 12/1996 Bryant
5,642,781 A 7/1997 Richard
5,664,628 A 9/1997 Koehler et al.
5,690,175 A 11/1997 Jones
5,787,980 A 8/1998 Sparlin et al.
5,803,179 A 9/1998 Echols et al.
5,842,516 A 12/1998 Jones
5,848,645 A 12/1998 Jones
5,868,200 A 2/1999 Bryant et al.
5,881,809 A * 3/1999 Gillespie ..... B01D 29/15 166/233
5,890,533 A 4/1999 Jones
5,896,928 A 4/1999 Coon
5,909,774 A 6/1999 Griffith et al.
5,934,376 A 8/1999 Nguyen et al.
6,003,600 A 12/1999 Nguyen et al.
6,112,817 A 9/2000 Voll et al.
6,125,932 A 10/2000 Hamid et al.
6,220,345 B1 4/2001 Jones et al.
6,223,906 B1 5/2001 Williams
6,227,303 B1 5/2001 Jones
6,230,803 B1 5/2001 Morton et al.
6,298,916 B1 10/2001 Tibbles et al.
6,302,207 B1 10/2001 Nguyen et al.
6,405,800 B1 6/2002 Walker et al.
6,409,219 B1 6/2002 Broome et al.
6,427,775 B1 8/2002 Dusterhoft et al.
6,446,722 B2 9/2002 Nguyen et al.
6,464,261 B1 10/2002 Dybevik et al.
6,481,494 B1 11/2002 Dusterhoft et al.
6,494,265 B2 12/2002 Wilson et al.
6,513,599 B1 2/2003 Bixenman et al.
6,516,881 B2 2/2003 Hailey, Jr.
6,540,022 B2 4/2003 Dusterhoft et al.
6,557,634 B2 5/2003 Hailey, Jr. et al.
6,575,245 B2 6/2003 Hurst et al.
6,575,251 B2 6/2003 Watson et al.
6,581,689 B2 6/2003 Hailey, Jr.
6,588,506 B2 7/2003 Jones
6,601,646 B2 8/2003 Streich et al.
6,619,397 B2 9/2003 Coon et al.
6,622,794 B2 9/2003 Zisk, Jr.
6,644,406 B1 11/2003 Jones
6,666,274 B2 12/2003 Hughes
6,675,245 B1 1/2004 Schmidt
6,695,067 B2 2/2004 Johnson et al.
6,698,518 B2 3/2004 Royer et al.
6,715,544 B2 4/2004 Gillespie et al.
6,749,023 B2 6/2004 Nguyen et al.
6,749,024 B2 6/2004 Bixenman
6,752,206 B2 6/2004 Watson et al.
6,752,207 B2 6/2004 Donos
6,755,245 B2 6/2004 Nguyen et al.
6,789,623 B2 9/2004 Hill, Jr. et al.
6,814,139 B2 11/2004 Hejl et al.
6,817,410 B2 11/2004 Wetzel et al.
6,830,104 B2 12/2004 Nguyen et al.
6,848,510 B2 2/2005 Bixenman et al.
6,857,475 B2 2/2005 Johnson
6,886,634 B2 5/2005 Richards
6,923,262 B2 8/2005 Broome et al.
6,935,432 B2 8/2005 Nguyen
6,983,796 B2 1/2006 Bayne et al.
6,986,390 B2 1/2006 Doanne et al.
6,997,263 B2 2/2006 Campbell et al.
7,048,061 B2 5/2006 Bode et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,152,677 B2 12/2006 Parlar et al.
7,207,383 B2 4/2007 Hurst et al.
7,234,518 B2 6/2007 Smith
7,243,724 B2 7/2007 McGregor et al.
7,252,142 B2 8/2007 Brezinski et al.
7,264,061 B2 9/2007 Dybevik et al.
7,370,700 B2 5/2008 Hurst et al.
7,377,320 B2 5/2008 Michel
7,383,886 B2 6/2008 Dybevik et al.
7,431,058 B2 10/2008 Holting
7,464,752 B2 12/2008 Dale et al.
7,475,725 B2 1/2009 Yeh et al.

(56) References Cited

U.S. PATENT DOCUMENTS

| | | | | |
|---|---|---|---|---|
| 7,625,846 | B2 | 12/2009 | Cooke, Jr. | |
| 7,661,476 | B2 | 2/2010 | Yeh et al. | |
| 7,735,559 | B2 | 6/2010 | Malone | |
| 7,814,973 | B2 | 10/2010 | Dusterhoft et al. | |
| 7,845,407 | B2 | 12/2010 | Bunnell et al. | |
| 7,870,898 | B2 | 1/2011 | Yeh et al. | |
| 7,891,420 | B2 | 2/2011 | Dale et al. | |
| 7,984,760 | B2 | 7/2011 | Haeberle et al. | |
| 8,127,831 | B2 | 3/2012 | Haeberle et al. | |
| 8,245,778 | B2 | 8/2012 | Yeh et al. | |
| 8,522,867 | B2 | 9/2013 | Yeh et al. | |
| 2002/0125008 | A1* | 9/2002 | Wetzel | A45C 13/02 166/278 |
| 2003/0159825 | A1 | 8/2003 | Hurst et al. | |
| 2003/0173075 | A1 | 9/2003 | Morvant et al. | |
| 2003/0189010 | A1 | 10/2003 | Wilhelm | |
| 2004/0007829 | A1 | 1/2004 | Ross | |
| 2004/0140089 | A1 | 7/2004 | Gunneroed | |
| 2005/0039917 | A1 | 2/2005 | Hailey, Jr. | |
| 2005/0045329 | A1 | 3/2005 | Wetzel et al. | |
| 2005/0067170 | A1 | 3/2005 | Richard | |
| 2005/0082060 | A1 | 4/2005 | Ward et al. | |
| 2005/0178562 | A1 | 8/2005 | Livingstone | |
| 2007/0114020 | A1 | 5/2007 | Brekke | |
| 2008/0006402 | A1 | 1/2008 | Russell | |
| 2008/0041577 | A1 | 2/2008 | Baaijens et al. | |
| 2008/0217002 | A1 | 9/2008 | Simonds et al. | |
| 2009/0159279 | A1 | 6/2009 | Assal | |
| 2009/0159298 | A1 | 6/2009 | Assal | |
| 2010/0096120 | A1 | 4/2010 | Ayasse | |
| 2012/0061093 | A1 | 3/2012 | Garcia et al. | |

OTHER PUBLICATIONS

Yeh, C.S. et al., "Advancing Self-Mitigating Sand Control Screen", IPTC 13614, International Petroleum Technology Conference, Dec. 7-9, 2009, 7 pages, Doha Qatar.

Yeh, C.S. et al., "Enhancing Sand Screen Reliability: An Innovative, Adaptive Approach", SPE 134492, SPE Annual Technical Conference, Sep. 19-22, 2010, 9 pages, Florence, Italy.

Yeh, C.S. et al., "Unlocking the Limits of Sand Screen Reliability with an Innovative and Self-Adapting Technology", IPTC 14623, 2011, 10 pages.

* cited by examiner

FLUID FILTERING DEVICE FOR A WELLBORE AND METHOD FOR COMPLETING A WELLBORE

CROSS REFERENCE TO RELATED APPLICATIONS

This application is the National Stage of International Application No. PCT/US2012/052085, filed Aug. 23, 2012, which claims the benefit of U.S. Provisional Application No. 61/546,400, filed Oct. 12, 2011, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions and downhole operations. More specifically, the present invention relates to a sand control device, and methods for conducting wellbore operations using a fluid filtering device.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

In some instances, a wellbore is completed in a formation that is loose or "unconsolidated." This means that as production fluids are produced into the wellbore, formation particles, e.g., sand and fines, may also invade the wellbore. Such particles are detrimental to production equipment. More specifically, formation particles can be erosive to downhole pumps as well as to pipes, valves, and fluid separation equipment at the surface.

The problem of unconsolidated formations can occur in connection with the completion of a cased wellbore. In that instance, formation particles may invade the perforations created through production casing and a surrounding cement sheath. However, the problem of unconsolidated formations is much more pronounced when a wellbore is formed as an "open hole" completion.

In an open-hole completion, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation. Second, open-hole techniques are oftentimes less expensive than cased hole completions. In this respect, an open-hole completion eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore will likely carry with it formation particles, e.g., sand and fines.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings or perforations. The base pipe is then typically wrapped with a filtration medium such as a well screen, a wire wrap screen, or a metal mesh screen.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together form a gravel slurry. The slurry dries in place, leaving a circumferential packing of gravel. The gravel not only aids in particle filtration but also helps maintain wellbore integrity.

It is also known in the oil and gas industry to deploy stand-alone screens. These screens are placed into the wellbore at the end of a production string. Generally, it is more cost effective to install a stand-alone sand screen than a gravel pack. However, stand-alone screens tend to be less robust than a gravel pack. The single sand control barrier in a stand-alone screen exposed to an initially open wellbore annulus is more susceptible to erosion damage during well production.

In either instance, sand screens are sometimes installed across highly pressurized formations. These formations may be subject to rapid erosion. When a screen is installed in, for example, a high-pressure, high-productivity formation having high permeability streaks, a sand screen can be particularly vulnerable to failure. A sand screen may also be locally plugged by residual mud or produced formation sand, leaving a "hot spot" for produced fluids. Such hot spots are prone to sand erosion. Further, sand screens can be damaged during run-in.

In order to strengthen the sand screen and to protect it from the so-called "hot spots," the MazeFlo™ sand control system has been previously developed. A patent was granted for this technology in 2008 as U.S. Pat. No. 7,464,752. In one embodiment, the technology offers a pair of concentric filtering tubular bodies that are dimensioned to be placed in a wellbore along a producing formation.

The tubular bodies include a first perforated base pipe. The first base pipe provides a first fluid flow path within a wellbore. At least one section of the first perforated base pipe is impermeable to fluids, while at least one section of the first perforated base pipe is permeable to fluids. The permeable section is adapted to retain particles larger than a predetermined size while allowing fluids to pass through the permeable section.

The tubular bodies also include a second perforated base pipe inside. The second base pipe provides a second fluid flow path within a wellbore. At least one section of the second perforated base pipe is impermeable to fluids, while at least one section of the second perforated base pipe is permeable to fluids. The permeable section is adapted to retain particles larger than a predetermined size while allowing fluids to pass through the permeable section.

The at least one permeable section of the first base pipe is in fluid communication with at least one permeable section of the second base pipe. In this way, fluid communication is provided between the first flow path and the second flow path. However, it is preferred that the at least one permeable section of the first base pipe be staggered from the at least one permeable section of the second base pipe.

The MazeFlo™ sand control system offers redundancy for a downhole screen. In this way, if an outer screen fails at any point, sand particles will still be filtered by an inner screen. The staggered design between the outer screen and inner screen streamlines any sand-laden flow and significantly reduces the erosion risk on the inner screen. U.S. Pat. No. 7,464,752 is incorporated herein in its entirety by reference.

Despite the success of the MazeFlo™ sand control system, a need exists for further technical developments in this area. Specifically, a need exists for an improved fluid filtering tool that may be used for either hydrocarbon production or fluid injection during a wellbore operation, and that provides redundancy in the filtering media.

SUMMARY OF THE INVENTION

A sand control device is first provided herein. The sand control device may be used for restricting the flow of particles from a subsurface formation into a tubular body within a wellbore. The sand control device is preferably between about 10 feet (3.05 meters) and 40 feet (12.19 meters) in length.

The sand control device is divided into compartments along its length. For example, the sand control device may have one, two, three, or even more compartments. In one aspect, each compartment is between about 5 feet (1.52 meters) and 10 feet (3.05 meters) in length.

Each compartment first comprises a base pipe. The base pipe defines an elongated tubular body having at least one permeable section and at least one impermeable section within each compartment. Each permeable section may comprise (i) circular holes, (ii) slots, (iii) a wire wrap (or wound) screen or a well screen, or (iv) combinations thereof for receiving formation fluids into a bore. Alternatively, the openings in the permeable section may be used to filter fluids during injection into a subsurface formation.

Each compartment also comprises a first filtering conduit. The first filtering conduit circumscribes the base pipe and forms a first annular region between the base pipe and the first filtering conduit. The first filtering conduit has a filtering medium adjacent the impermeable section of the base pipe. The filtering medium is constructed to filter sand and other formation particles while allowing an ingress of formation fluids.

Each compartment also has a second filtering conduit that is longitudinally adjacent to the first filtering conduit. The second filtering conduit also circumscribes the base pipe and forms a second annular region between the base pipe and the second filtering conduit. The second filtering conduit has a filtering medium adjacent the permeable section of the base pipe. The filtering medium is constructed to filter sand and other formation particles while allowing an ingress of formation fluids.

In addition, each compartment also includes a tubular housing. The tubular housing is a section of blank pipe that sealingly circumscribes at least the second filtering conduit. The tubular housing forms a third annular region between the second filtering medium and the surrounding housing.

Each compartment further comprises an under-flow ring. The under-flow ring is disposed longitudinally between the first filtering conduit and the second filtering conduit for directing fluid flow from the first annular region into the third annular region. The under-flow ring comprises a short tubular body having an inner diameter and an outer diameter. The outer diameter sealingly receives the blank tubular housing at an end.

The under-flow ring also has at least two inner ridges that are radially spaced about the inner diameter. The under-flow ring further has flow channels between the at least two inner ridges. The flow channels direct formation fluids into the third annular region.

Optionally, the sand control device further comprises a baffle ring. The baffle ring is also disposed longitudinally between the under-flow ring and the second filtering medium. The baffle ring serves to circumferentially disperse fluids as the fluids move from the first annular region to the third annular region. The baffle ring defines a tubular body having an inner diameter and an outer diameter. In one aspect, the baffle ring comprises at least two outer ridges radially and equi-distantly spaced about the outer diameter. Flow channels are formed between the at least two outer ridges for dispersing formation fluids as they enter the third annular region. The outer ridges are preferably oriented to the flow channels in the under-flow ring.

As another option, a section of blank pipe is disposed between the under-flow ring and the second filtering conduit. For example, a section of blank pipe may be an extension of the impermeable base pipe between the under-flow ring and the second filtering conduit. The blank pipe permits a circumferential dispersion of fluids as the fluids travel from the first annular region to the third annular region. This may be used in addition to or in lieu of the baffle ring. In either instance, the housing also circumscribes the section of blank pipe.

A method for completing a wellbore in a subsurface formation is also provided herein. In one embodiment, the method first includes providing a sand control device. The sand control device is designed in accordance with the sand control device described above, in its various embodiments.

The method also includes running the sand control device into a wellbore. The sand control device is lowered to a selected subsurface location. The sand control device thereby forms an annulus in the wellbore between the sand control device and the surrounding wellbore.

The sand control device may be run into a new wellbore as a stand-alone screen. Alternatively, the sand control device may be placed in the wellbore along with a gravel pack. In this latter arrangement, the method further includes injecting a gravel slurry into the wellbore. The gravel slurry is injected in order to form a gravel pack in the annulus between the sand control device and the surrounding formation.

In one aspect, the sand control device comprises at least one shunt tube external to the first filtering conduit, the second filtering conduit, and the housing. The at least one shunt tube can also be internal to the first filtering conduit and the housing, and either internal or external to the second filtering conduit. The at least one shunt tube runs longitudinally substantially along the first compartment and the second compartment, and provides an alternate flow channel for gravel slurry during the gravel-packing operation. In this instance, the method further comprises injecting the gravel slurry at least partially through the at least one shunt tube to allow the gravel slurry to bypass any premature sand bridges or zonal isolation devices (such as a packer) around or near the sand control device so that the wellbore is more uniformly gravel-packed within the annulus.

The base pipe is preferably in fluid communication with a string of production tubing. In one embodiment, the production tubing is used for the production of hydrocarbons from the wellbore. In this instance, the flow channels of the under-flow ring are oriented to direct the flow of production fluids from the first annular region into the third annular region, then through the second annular region and into the base pipe, and then up to surface via the production tubing during a production operation. In another embodiment, the base pipe is in fluid communication with a string of injection tubing. The tubing here is used for the injection of an aqueous or other fluid through the wellbore and into a subsurface formation. In this instance, the flow channels of the under-flow ring are oriented to direct the flow of injection fluids from the base pipe to the second annular region, then through the third annular region and into the first annular region during fluid injection or stimulation operation.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 9A provides a cross-sectional view of a portion of a sand screen disposed along an open-hole portion of a wellbore. A gravel pack has been placed around the sand screen and within the surrounding open-hole formation.

FIG. 9B is a cross-sectional view of the sand screen of FIG. 9A, taken across line B-B of FIG. 9A. Alternate flow channels are seen internal to the screen.

FIG. 9C is another cross-sectional view of the sand screen of FIG. 9A. This view is taken across line C-C of FIG. 9A.

FIG. 10 shows steps for a method of completing a wellbore using a sand control device, in one embodiment.

DETAILED DESCRIPTION OF CERTAIN EMBODIMENTS

Definitions

Figure 1:
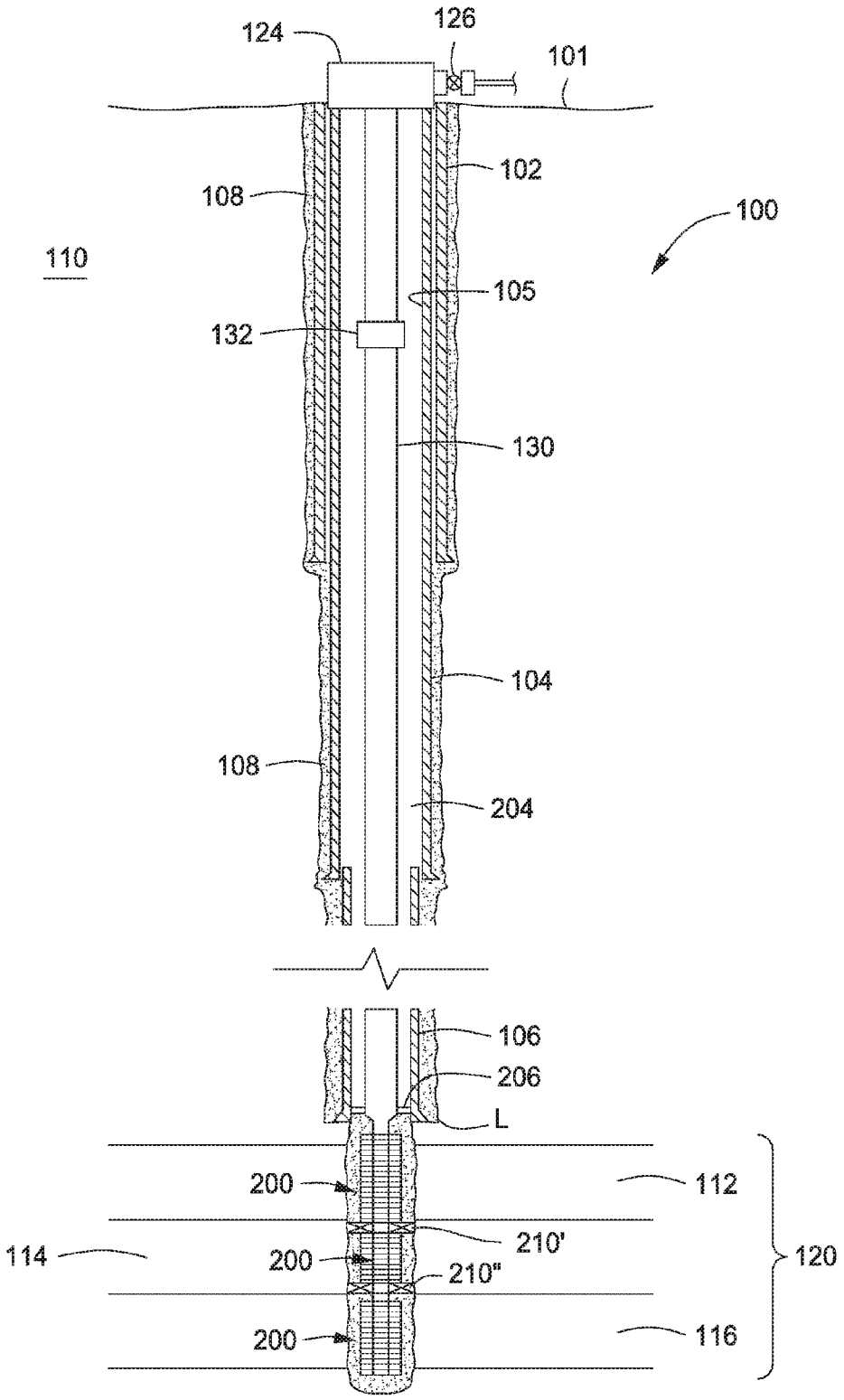
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface formation" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" or "tubular body" refers to any pipe, such as a joint of casing, a tubing, a portion of a liner, or a pup joint.

The term "sand control device" means any elongated tubular body that permits an inflow of fluid into an inner bore or a base pipe while filtering out predetermined sizes of sand, fines and granular debris from a surrounding formation. A wire-wrapped screen is an example of a sand control device.

The term "alternate flow channel" means any collection of manifolds and/or shunt tubes that provide fluid communication through or around a packer to allow a gravel slurry to by-pass the packer elements or any premature sand bridge in the annular region, and to continue gravel packing further downstream. The term "alternate flow channels" can also mean any collection of manifolds and/or shunt tubes that provide fluid communication through or around a sand control device or a tubular member (with or without outer protective shroud) to allow a gravel slurry to by-pass any premature sand bridge in the annular region and continue gravel packing below, or above and below, the premature sand bridge or any downhole tool.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed or prepared for the purpose of producing hydrocarbons (e.g., typically gas, oil, condensate) and/or other fluids (e.g., water, steam, carbon dioxide, other gases) for sale or use. A string of production tubing 130 is provided in the bore 105 to transport production fluids from the open-hole portion 120 up to the surface 101.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event at the surface or above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the surrounding casing string 104, 106. A production packer 206 seals the annular region 204 near the lower end "L" of the casing string (or liner) 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In connection with the production of hydrocarbon fluids from a wellbore having an open-hole completion 120, it is desirable to limit the influx of sand particles and other fines. In order to prevent the migration of formation particles into the production string 134 during operation, sand control devices 200 have been run into the wellbore 100.

Figure 2:
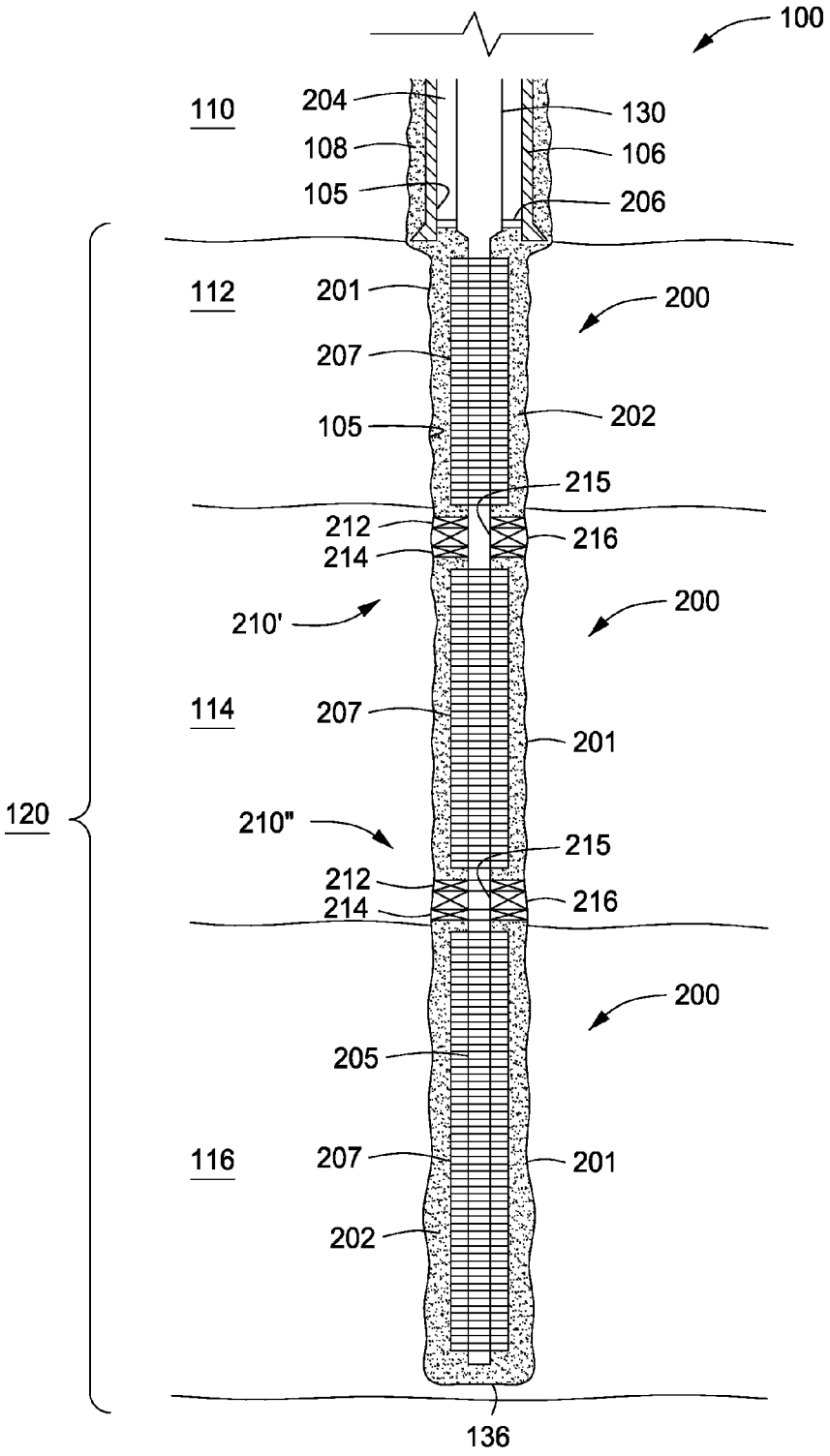
FIG. 2 is an enlarged cross-sectional view of an open-hole completion of the wellbore of FIG. 1. The open-hole completion at the depth of the three illustrative intervals is more clearly seen.

FIG. 2 provides an enlarged cross-sectional view of the open-hole portion 120 of the wellbore 100 of FIG. 1. The sand control devices 200 are more clearly seen. Each of the sand control devices 200 contains an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen comprises a membrane screen, an expandable screen, a sintered metal screen, a porous media made of shape memory polymer, a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more optional packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100. Further, the illustrative packer assemblies 210', 210" are positioned to isolate the annular region 202 above and below the intermediate interval 114.

Each packer assembly 210', 210" may have at least two packers. The packers are preferably set through a combination of mechanical manipulation and hydraulic forces. The packer assemblies 210 represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

The elements for the upper 212 and lower 214 packers should be able to withstand the pressures and loads associated with a gravel packing process. Typically, such pressures are from about 2,000 psi to 3,000 psi. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The elements for the packers 212, 214 are preferably cup-type elements. In one embodiment, the cup-type elements need not be liquid tight, nor must they be rated to handle multiple pressure and temperature cycles. The cup-type elements need only be designed for one-time use, to wit, during the gravel packing process of an open-hole wellbore completion. This is because an intermediate swellable packer element 216 is also preferably provided for long term sealing.

The optional intermediate packer element 216 defines a swelling elastomeric material fabricated from synthetic rubber compounds. Suitable examples of swellable materials may be found in Easy Well Solutions' Constrictor® or SwellPacker®, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

A mandrel 215 is shown running through the packers 212, 214. The swellable packer element 216 is preferably bonded to the outer surface of the mandrel 215. The swellable packer element 216 is allowed to expand over time when contacted by hydrocarbon fluids, formation water, or other actuating fluid. As the packer element 216 expands, it forms a fluid seal with the surrounding zone, e.g., interval 114.

The upper 212 and lower 214 packers are set prior to a gravel pack installation process. The mechanically set packers 212, 214 are preferably set in a water-based gravel pack fluid that would be diverted around the swellable packer element 216, such as through shunt tubes (not shown in FIG. 2). If only a hydrocarbon swelling elastomer is used, expansion of the element may not occur until after the failure of either of the elements in the mechanically set packers 212, 214.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide. The operator may set a plug adjacent packer assembly 210" to seal off the lower interval 116. Alternatively, the operator may place a straddle packer across each of the two packer assemblies 210', 210" to seal off production from the intermediate interval 114.

Figure 3:
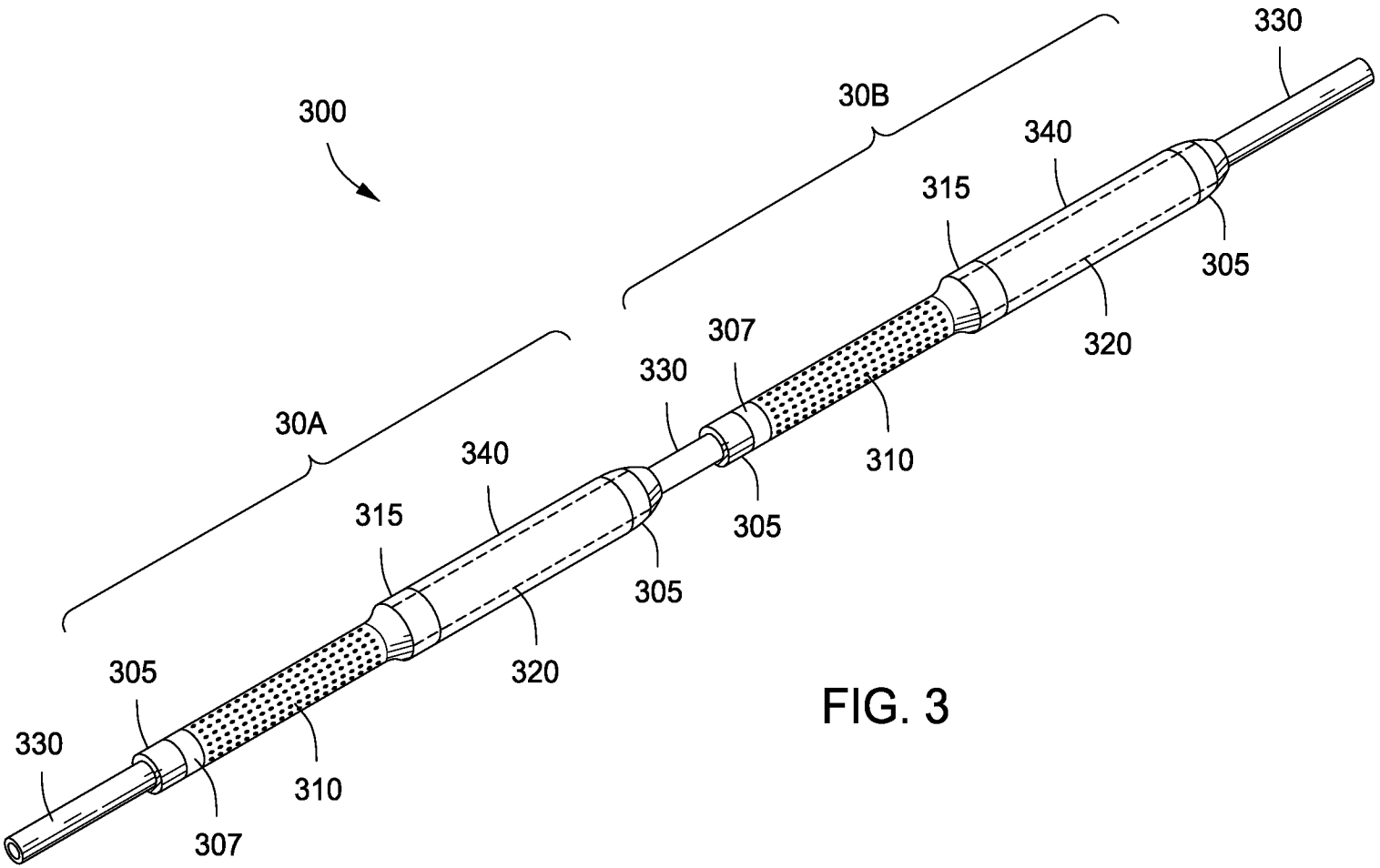
FIG. 3 is a perspective view of a sand screen joint according to the present invention, in one embodiment. Two "compartments" of the sand screen joint are seen.

Referring now to FIG. 3, FIG. 3 is a perspective view of a sand screen joint 300 according to the present invention, in one embodiment. The illustrative sand screen joint 300 presents one arrangement for the sand screen joints 200 of FIGS. 1 and 2. The sand screen joint 300 defines an elongated tubular body. More specifically, the sand screen joint 300 defines a series of pipe joints that are circumferentially disposed within another series of pipe joints for receiving formation fluids.

The sand screen joint 300 exists for the purpose of filtering formation particles, e.g., clay particles and sand, from the formation fluids. The sand screen joint 300 may be placed in a wellbore that is completed substantially vertically, such as wellbore 100 of FIG. 1. Alternatively, the sand screen joint 300 may be placed longitudinally along a formation that is completed horizontally or that is otherwise deviated. As formation fluids enter the wellbore, the fluids travel into the sand screen joint 300 under pressure. The fluids then progress to the surface. The surface may be a land surface such as shown at surface 101 in FIG. 1; alternatively, the surface may be an ocean bottom (not shown).

Along the sand screen joint 300 is a filtering medium. The filtering medium is divided into primary sections 310 and secondary sections 320. In the arrangement of FIG. 3, two groupings of primary 310 and secondary 320 sections are indicated. Each of these groupings represents a "compartment." The compartments are indicated at 30A and 30B.

It is preferred that a wellbore be completed with a plurality of sand screen joints 300, with each joint 300 being between 10 feet (3.05 meters) and 40 feet (12.19 meters). Each sand screen joint 300 has at least one compartment, 30A or 30B. In the case of one compartment, the compartment length can be up to the length of screen joint 300. It is also preferred that each sand screen joint have at least two, and possibly even six, compartments 30A/30B. For example, each compartment may be between about 5 feet (1.52 meters) and 10 feet (3.05 meters) in length.

In one preferred arrangement, the sand screen joint 300 is 30 feet (9.14 meters) long, and comprises a first primary section, followed by a first secondary section, followed by a second primary section, followed by a second secondary section, with each of these four sections being about six feet in length. The remaining six feet is taken up by under-flow rings 315, baffles (such as baffle 350 of FIGS. 4B and 7), threaded connection ends (not shown) and extensions of blank pipe. The extensions of blank pipe would be for baffle extensions, compartment dividers, and connection make-up in field installation.

It is understood that numerous combinations of tubular sections may be employed. The present invention is not limited by dimensions or the number of compartments used unless expressly stated in the claims herein.

In order to transport fluids to the surface 101, the sand screen joint 300 includes a base pipe. The base pipe is not visible in the view of FIG. 3; however, the base pipe is shown at 335*b* in FIG. 4A, and at 335*p* in FIG. 4B. As will be discussed more fully below, base pipe 335*b* represents a section of blank pipe, while base pipe 335*p* is a section of perforated or slotted pipe. The base pipes 335*b* and 335*p* transport formation fluids towards the surface 101.

To effectuate the transport of formation fluids to the surface 101, the base pipes 335*b*, 335*p* are in fluid communication with a tubular body 330. The tubular body 330 represents sections of "blank" tubular members. The base pipes 335*b*, 335*p* and the tubular body 330 may be the same tubular member. The tubular body 330, in turn, is in fluid communication with the production tubing 130 (shown in FIGS. 1 and 2). The tubular body 330 is threadedly connected to the production tubing 130 at or below the packer 206 to form a fluid conduit that delivers production fluids to the surface 101. In practice, the tubular body 330 may actually be sections of production tubing 130. The tubular body 330 may alternatively be a section of a tubular body threadedly connected to the screen joint 300.

Portions of the tubular body 330 extend from either or both ends of the compartments 30A, 30B. Split rings 305 are applied at opposing ends of the compartments 30A, 30B to create a seal between the compartments 30A, 30B and the tubular body 330. The split rings 305 are shown in and described more fully in connection with FIGS. 5A and 5B, below.

In the sand screen joint 300, the filtering function of the joint 300 is substantially continuous along the tool's length. However, the filtering media of the joint 300 are not continuous; rather sections of blank base pipe 335*b* and perforated base pipe 335*p* are staggered with sections of primary 310*f* and secondary 320*f* filtering conduit. In this way, if a portion of the filtering medium in the primary conduit 310*f* fails, movement of sand will nevertheless be filtered before entering the perforated base pipe 335*p*. In this respect, formation fluids are still forced to flow along the blank base pipe 335*b* and towards the secondary section 320, where the fluids will then pass through the filtering medium of the secondary filtering conduit 320*f* and into the perforated base pipe 335*p*.

Figure 4A:
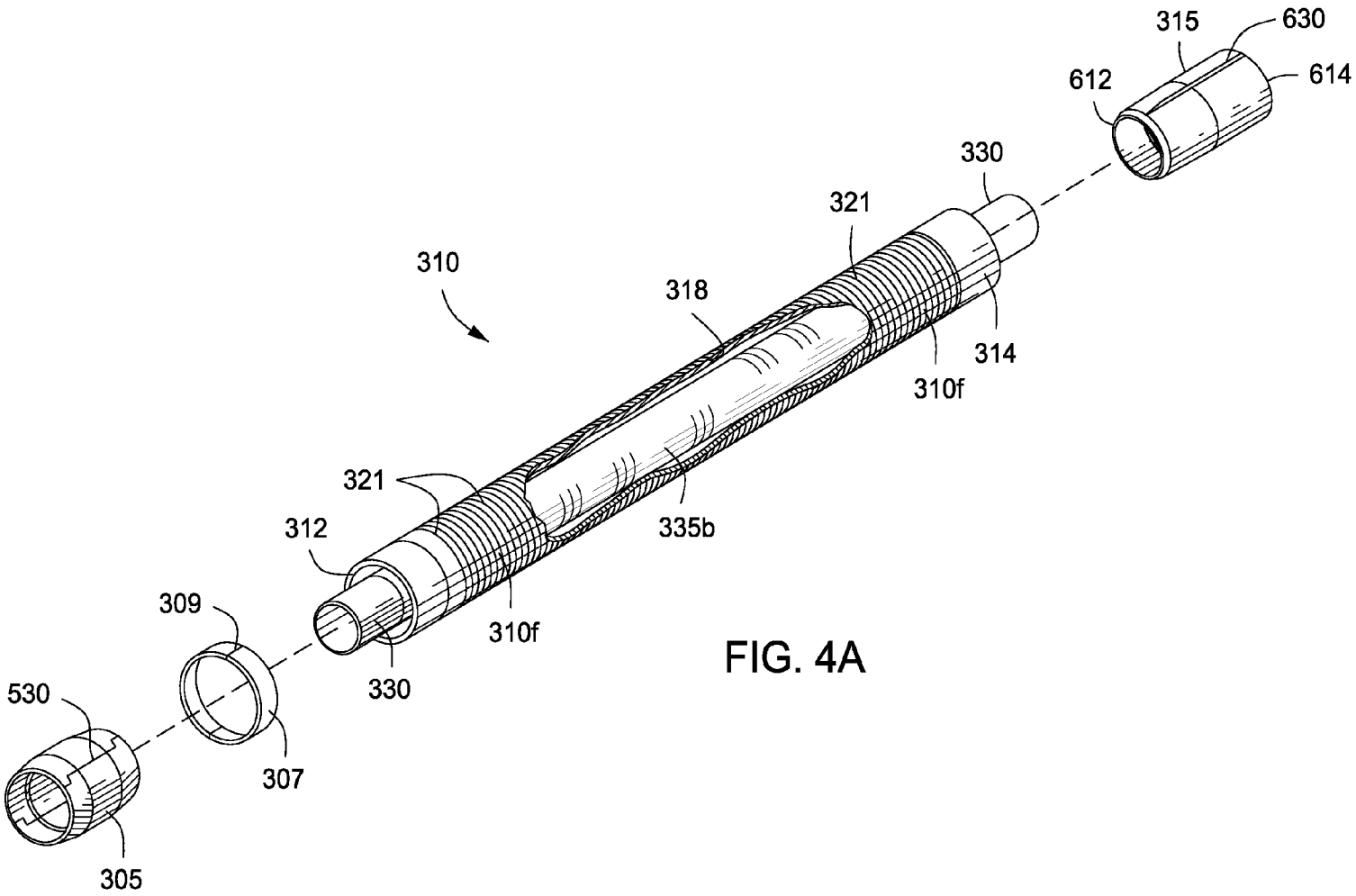
FIG. 4A is a perspective view of a portion of the sand screen joint of FIG. 3. In this view, a split-ring, a welding ring, a primary permeable section, and an under-flow ring are shown exploded apart. A portion of the primary permeable section is cut-away, exposing a non-perforated base pipe there along.

FIG. 4A provides an exploded perspective view of a portion of the sand screen joint 300 of FIG. 3. Specifically, the primary section 310 of the sand screen joint 300 is seen. The primary section 310 first includes the elongated base pipe 335*b*. As can be seen, this section of base pipe 335*b* is blank pipe.

Circumscribing the base pipe 335*b* is a filtering conduit 310*f*. The filtering conduit 310*f* defines a filtering medium substantially along its length, and serves as a primary permeable section. A portion of the filtering conduit 310*f* is cut-away, exposing the blank (non-perforated) base pipe 335*b* there along.

The filtering medium for the filtering conduit 310*f* may be a wire mesh screen. Alternatively, and as shown in the illustrative arrangement of FIG. 4A, the filtering medium is a wire-wrapped screen. The wire-wrapped screen provides a plurality of small helical openings 321 or slots. The helical openings 321 are sized to permit an ingress of formation fluids while restricting the passage of sand particles over a certain gauge.

The filtering conduit 310*f* is preferably placed around the base pipe 335*b* in a substantially concentric manner. The filtering conduit 310*f* has a first end 312 and a second end 314. The first 312 and second 314 ends are optionally tapered down to a smaller outer diameter. In this way, the ends 312, 314 may be welded to connector parts that control the flow of formation fluids in an annular region 318 between the non-perforated base pipe 335*b* and the surrounding filtering conduit 310*f*.

In FIG. 4A, the helical slots are shown extending substantially along the length of the filtering conduit 310*f*. Optionally, the slots extend all the way to opposing ends 312 and 314 to maximize flow coverage.

In the arrangement of FIG. 4A, the primary section 310 includes a split-ring 305. The split-ring 305 is dimensioned to be received over the tubular body 330, and then abut against the first end 312 of the filtering conduit 310*f*. FIG. 5A provides an enlarged perspective view of the split-ring 305 of FIG. 4A. The illustrative split-ring 305 defines a short tubular body 510, forming a bore 505 therethrough.

The split-ring 305 has a first end 512 and a second end 514. The split-ring 305 is preferably formed by joining two semi-spherical pieces together. In FIG. 5A, two seams 530 are seen running from the first end 512 to the second end 514.

Figure 5B:
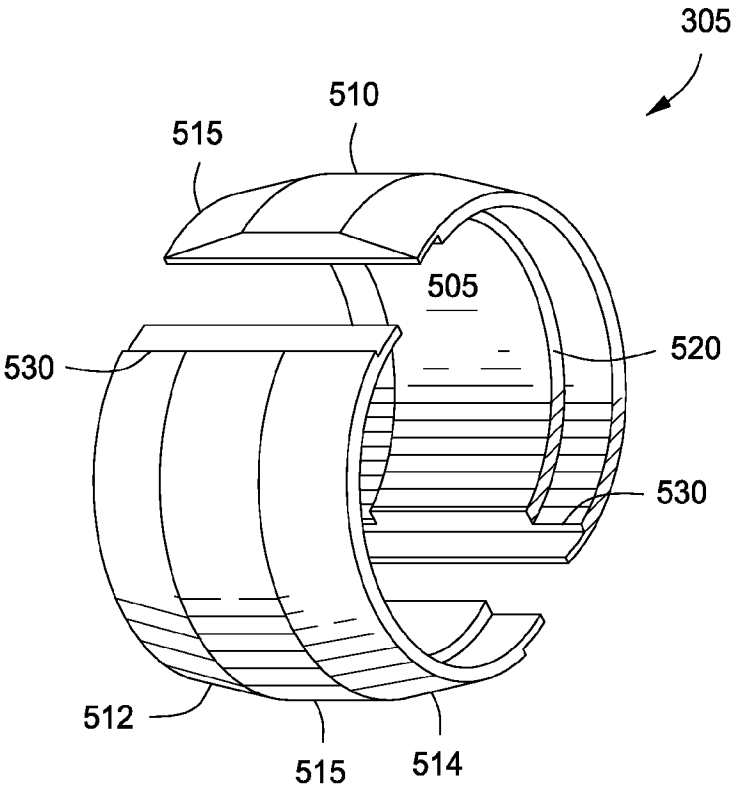
FIG. 5B is a perspective view of the split-ring of FIG. 5A. The split-ring is shown as being separated along the two seams for illustrative purposes.
Figure 5A:
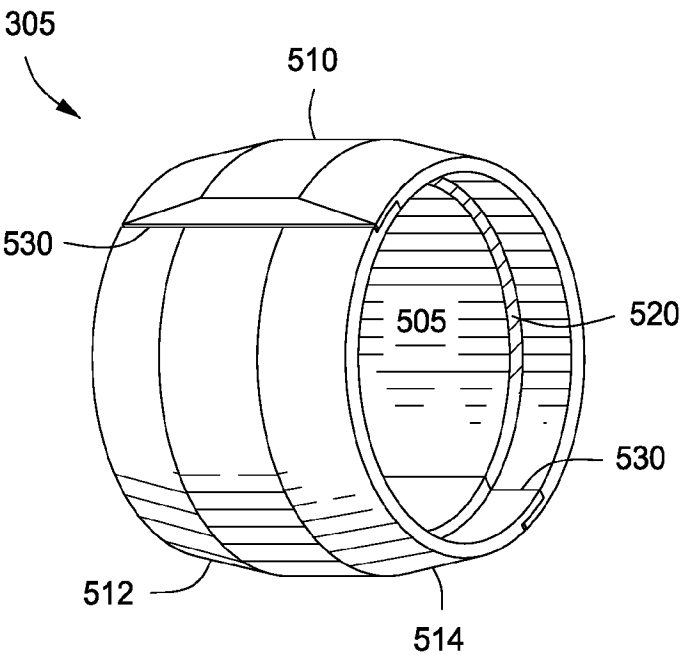
FIG. 5A is a perspective view of a split-ring as may be used for connecting components of the sand screen joint of FIG. 4A. The illustrative split-ring has two seams.

FIG. 5B presents another perspective view of the split-ring 305 of FIG. 5A. Here, the split-ring 305 is shown as separated along the two seams 530. During fabrication, two semi-spherical pieces 515 are placed over the tubular body 330 and abutted against the filtering conduit 310*f* at the first end 312. The joined semi-spherical pieces 515 are then welded together, and may also be optionally welded to the first end 312 of the first filtering conduit 310*f*. The semi-spherical pieces 515 may also be welded to the non-perforated base pipe 335*b* or to the tubular body 330

In order to seal the annular region 318 between the non-perforated base pipe 335*b* and the surrounding filtering conduit 310*f*, a shoulder 520 is placed along the bore 505 of the split-ring 305. The shoulder 520 is abutted on the filtering conduit 310*f* and is sized to at least partially fill the annular region 318. The larger internal diameter of the split-ring 305 between the shoulder 520 and the second end 514 is sized to closely fit around the filter medium of the filtering conduit 310*f* near the first end 312. The close fit prevents a pre-determined size of particles from entering a gap (not indicated) between the split-ring 305 and the filter medium. The split-ring 305 thus helps to prevent the flow of formation fluids into the annular region 318 without first passing through the filter medium of the filtering conduit 310*f*.

It is noted that each end 512, 514 of the split-ring 305 will preferably have a shoulder 520. A short tubular sub (not shown) may be inserted into the bore 505 of the split-ring 305 opposite the filtering conduit 310*f*. The sub will have a threaded end for threadedly connecting to a packer, another compartment of the sand control joint 300, a section of blank pipe, or any another tubular body desired for completing the wellbore.

FIG. 4A also shows a welding ring 307. The welding ring 307 is an optional circular body that offers additional welding stock. In this way, the filtering conduit 310*f* may be sealingly connected to the welding ring 307. The welding ring 307 may have seams 309 that allow the welding ring 307 to be placed over the tubular body 330 for welding. Optional welding rings 307 are also shown in FIG. 3 adjacent split-rings 305.

FIG. 4A also shows an under-flow ring 315. In a production mode, the under-flow ring 315 is designed to receive formation fluids as they flow out of the annular region 318 of the primary section 310 and en route to the secondary section 320. The under-flow ring 315 is shown exploded apart from the second end 314 of the filtering conduit 310*f*.

Figure 6B:
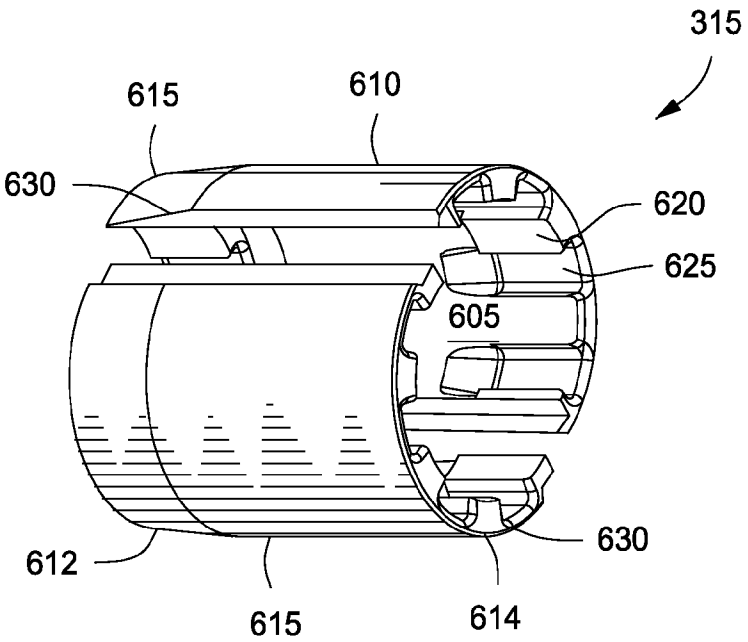
FIG. 6B is a perspective view of the under-flow ring of FIG. 6A. The under-flow ring is shown as being separated along the two seams for illustrative purposes.
Figure 6A:
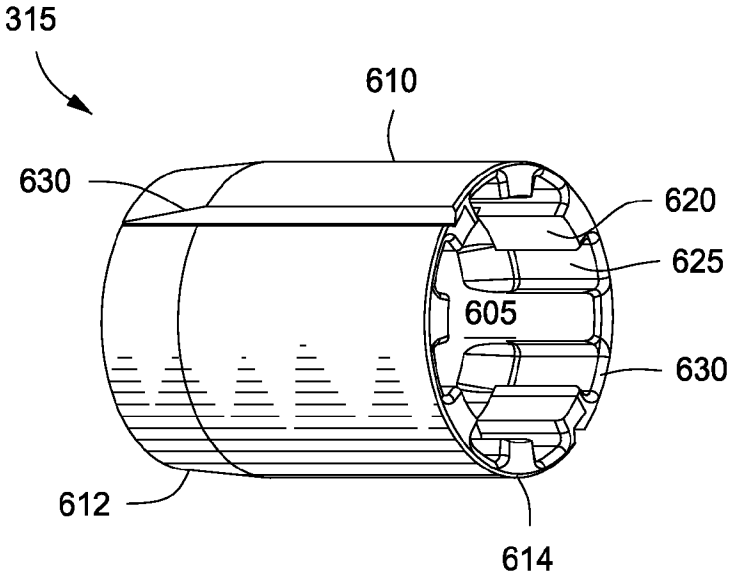
FIG. 6A is a perspective view of an under-flow ring as may be used for fluidly connecting the primary and secondary sections of the sand screen joint of FIGS. 4A and 4B. The illustrative under-flow ring has two seams.

FIG. 6A provides an enlarged perspective view of the under-flow ring 315 of FIG. 4A. The illustrative under-flow ring 315 defines a short tubular body 610, forming a bore 605 therethrough.

The under-flow ring 315 has a first end 612 and a second end 614. The under-flow ring 315 is preferably formed by joining two semi-spherical pieces together. In FIG. 6A, two seams 630 are seen running from the first end 612 to the second end 614.

FIG. 6B presents another perspective view of the under-flow-ring 315 of FIG. 6A. Here, the under-flow ring 315 is shown as being separated along the two seams 630. During fabrication, two semi-spherical pieces 615 are placed over the outer diameter of a filtering conduit 310*f* of an adjoining primary section 310 at the second end 314. The joined semi-spherical pieces 615 are then welded together, and also welded to the base pipe 335*b* or the tubular body 330 next to the second end 314 of the filtering conduit 310*f* to form an annular seal.

In order to seal the annular region 318 between the non-perforated base pipe 335*b* and the surrounding filtering conduit 310*f* at the second end 314 of the filtering conduit 310*f*, a shoulder (not seen in FIG. 3) similar to 520 in FIG. 5A is placed along the bore 605 of the under-flow ring 315 near the first end 612. The shoulder is abutted on the filter medium of filtering conduit 310*f* and sized to at least partially open the bore 605 to the annular region 318. The larger bore diameter of underflow-ring 315 between the shoulder and the first end 612 is sized to closely fit around the filter medium of the filtering conduit 310*f* near the second end 314. The close fit prevents a pre-determined size of particles from entering the gap between the under-flow ring and the filter medium of the filtering conduit 310*f*. The underflow ring 315 prevents the flow of formation fluids into the annular region 318 without first passing the filter medium of the filtering conduit 310*f*.

The under-flow ring 315 includes a plurality of inner ridges 620 near the second end 614. The ridges 620 are radially and equi-distantly spaced along an inner diameter of the under-flow ring 315. The inner ridges 620 form flow channels 625 there between. The flow channels 625 receive formation fluids as they leave the annular region 318 of the primary section 310 and enter the secondary section 320 of the sand screen joint 300.

The formation fluids enter the first end 612 of the under-flow ring 315, and are released from the second end 614. From there, the formation fluids flow over the filtering conduit 320*f* of the secondary section 320.

Figure 4B:
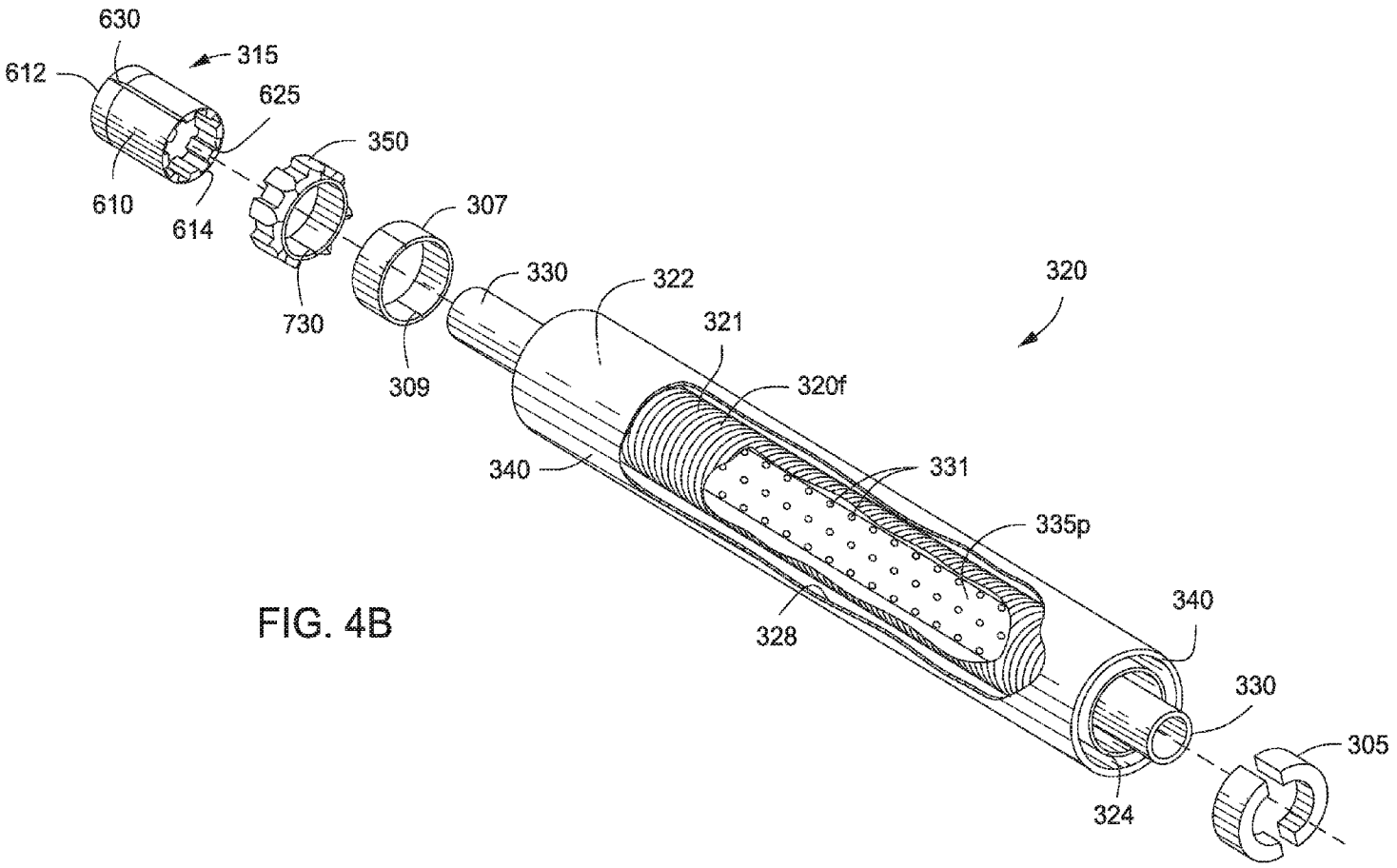
FIG. 4B is another perspective view of a portion of the sand screen joint of FIG. 3. In this view, an under-flow ring, a baffle ring, a welding ring, and a secondary permeable section are shown exploded apart. A portion of the secondary permeable section is cut-away, exposing a perforated base pipe there along.

FIG. 4B is an exploded perspective view of another portion of the sand screen joint 300 of FIG. 3. Specifically, the secondary section 320 of the sand screen joint 300 is seen. The secondary section 320 first includes the elongated base pipe 335*p*. As can be seen, this section of base pipe 335*p* is perforated. Alternatively, the base pipe 335*p* may have slots or other fluid ports. In FIG. 4B, fluid ports are seen at 331.

Circumscribing the base pipe 335*p* is the second filtering conduit 320*f*. The filtering conduit 320*f* also includes a filtering medium. The filtering conduit 320*f* serves as a secondary permeable section. A portion of the filtering conduit 320*f* is cut-away, exposing the perforated base pipe 335*p* there-along. The filtering medium of the illustrative filtering conduit 320*f* is again a wire-wrapped screen, although it could alternatively be a wire-mesh. The wire-wrapped screen provides a plurality of small helical openings 321. The helical openings 321 are sized to permit an ingress of formation fluids while restricting the passage of sand particles over a certain gauge.

The second filtering conduit 320*f* has a first end 322 and a second end 324. The first 322 and second 324 ends are optionally tapered down to a smaller outer diameter. In this way, the ends 322, 324 may be welded to connector parts 305, 307, 315 that control the flow of formation fluids in an annular region 328 between the filtering conduit 320*f* and a surrounding housing 340.

In FIG. 4B, the under-flow ring 315 is again seen. Here, the second end 614 of the under-flow ring 315 is to be connected proximate the first end 322 of the filtering conduit 320*f*. Specifically, an inner diameter of the housing 340 is welded onto an outer diameter of the body 610 of the under-flow ring 315. In this way, formation fluids are sealingly delivered from the annular region 318, through the flow channels 625, and into the annular region 328.

The under-flow rings 315 seal the open ends of the annular region 328. The under-flow rings are welded on the base pipe 338*b*, and provide a flow transit from the annular region 318 to the annular region 328. The under-flow rings convert annular flow from the first conduit to about eight circumferentially-spaced flow ports. The under-flow rings 315 also provide support for the housing 340 via welding.

In the production mode, it is desirable to disperse the formation fluids circumferentially around the annular region 328. In this way, fluid flow is more uniform as it flows over and through the filtering conduit 320*f*. Accordingly, the second section 320 also optionally includes a baffle ring 350. The baffle ring 350 may optionally be placed just before but proximate to the second section 320.

Figure 7:
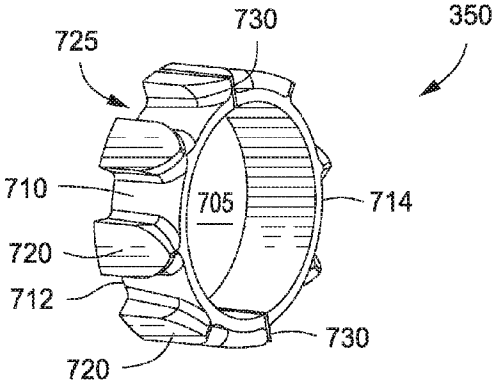
FIG. 7 is an enlarged perspective view of the baffle ring of FIG. 4B. A plurality of radial channels are seen between baffles formed around the baffle ring.

In the view of FIG. 4B, the under-flow ring 315 is exploded away from the filtering conduit 320*f*. The baffle ring 350 is seen intermediate the under-flow ring 315 and the filtering conduit 320*f*. FIG. 7 provides an enlarged perspective view of the baffle ring 350 of FIG. 4B alone. The illustrative baffle ring 350 defines a short tubular body 710, forming a bore 705 therethrough. No fluids flow through the bore 705.

The baffle ring 350 has a first end 712 and a second end 714. The baffle ring 350 is preferably formed by joining two semi-spherical pieces together. In FIG. 7, two seams 730 are seen running from the first end 712 to the second end 714. The seams 730 enable the baffle ring 350 to be placed over a section of non-perforated pipe as an extension to the perforated base pipe 335*p* as two pieces during fabrication. The seams 730 are then welded together and the baffle ring 350 is welded onto the outside of the selected pipe to form an annular seal.

The baffle ring 350 includes a plurality of outer ridges, or baffles 720. The baffles 720 are placed radially and equidistantly around an outer diameter of the baffle ring 350. The baffles 720 disrupt the linear flow of the formation fluids as they exit the second end 614 of the under-flow ring 315.

Between the baffles 720 are a plurality of flow-through channels 725. The flow-through channels 725 direct the flow of formation fluids more evenly toward an outer diameter of the filtering medium 320*f* of the secondary section 320.

Figure 8B:
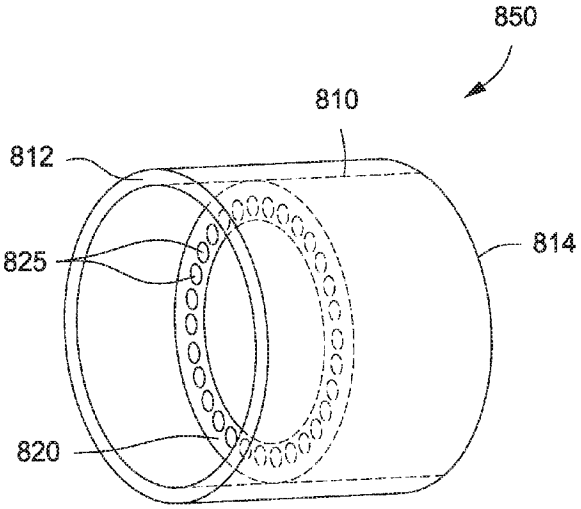
FIGS. 8A and 8B are perspective views of a baffle ring as may be used in the sand screen joint of FIG. 3, in an alternate arrangement. A plurality of fluid distribution ports are seen along the circumference of the baffle ring.
Figure 8A:
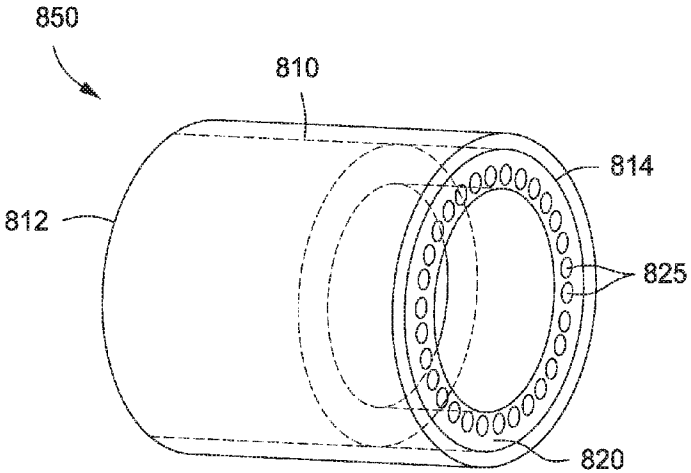

The baffle ring 350 of FIG. 7 is but one of many fluid baffling arrangements that may be optionally used. FIGS. 8A and 8B provide perspective views of a baffle ring 850 as may be used in the sand screen joint 300 of FIGS. 4A and 4B, in an alternate arrangement.

The baffle ring 850 also represents a short tubular body 810 forming a bore 805 therethrough. The body 810 has a first end 812 and a second end 814. The perspective view of FIG. 8A presents the second end 814, while the perspective view of FIG. 8B presents the first end 812. The baffle ring 850 may contain a shoulder similar to 520 in FIG. 5A.

The baffle ring 850 includes an inner shoulder 820. Placed radially and equi-distantly around the shoulder 820 is a plurality of fluid distribution ports 825. The fluid distribution ports 825 receive formation fluids from the second end 614 of the under-flow ring 315, and deliver the fluids into the annular region 328 around the second filtering conduit 320*f*.

It is noted that the secondary section 320 need not employ a definite baffling ring, whether in the form of ring 350, ring 850, or other ring. Instead, fluid dispersion may take place by using an extended length of blank pipe, such as tubular body 330. In this instance, the outer housing 340 extends over the tubular body 330 before connecting to the under-flow ring 315. For instance, 2 feet (0.61 meters) to 5 feet (1.52 meters) of pipe may be spaced between the under-flow ring 315 and the second filtering conduit 320*f*.

Returning back to FIG. 4B, the exploded perspective view of the secondary section 320 also includes a welding ring 307. The welding ring 307 is a circular body that is welded to the first end 322 of the filter medium of the second filtering conduit 320*f* and the tubular body 330 to seal the first end 322 of the second filtering conduit 320*f*. The welding ring 307 prevents fluids in the annulus 328 from reaching fluid ports 331 on the base pipe 335*p* without first passing the filter medium of the second filtering conduit 320*f*. Optionally, the welding ring 307 may be replaced by or combined with a split-ring 305.

FIG. 4B shows the second end 324 of the filtering conduit 320*f* as being open. In actual use, this second end 324 will be sealingly attached to a connector. Preferably, the connector is a split-ring 305. The split-ring 305 may seal the annular region 328 between the filter medium of the second filtering conduit 320*f* and the base pipe 335*p* at the second end 324 of the secondary section 320. The housing 340 welded onto the split-ring 305 seals the annular region 328.

As noted, FIG. 3 provides a perspective view of a sand screen joint 300, in one embodiment. The sand screen 300 may be installed as a standalone tool for downhole sand control. The sand screen 300 may also be installed and surrounded by a gravel pack. In gravel pack completions, the sand screen 300 is optionally equipped with shunt tubes. Illustrative shunt tubes for a well screen are described in U.S. Pat. Nos. 4,945,991, 5,113,935, and 5,515,915.

External features of the sand screen joint 300 are shown in FIG. 3. In order to better understand the flow control function of the sand screen joint 300, a cross-sectional view is beneficial.

Figure 9A:
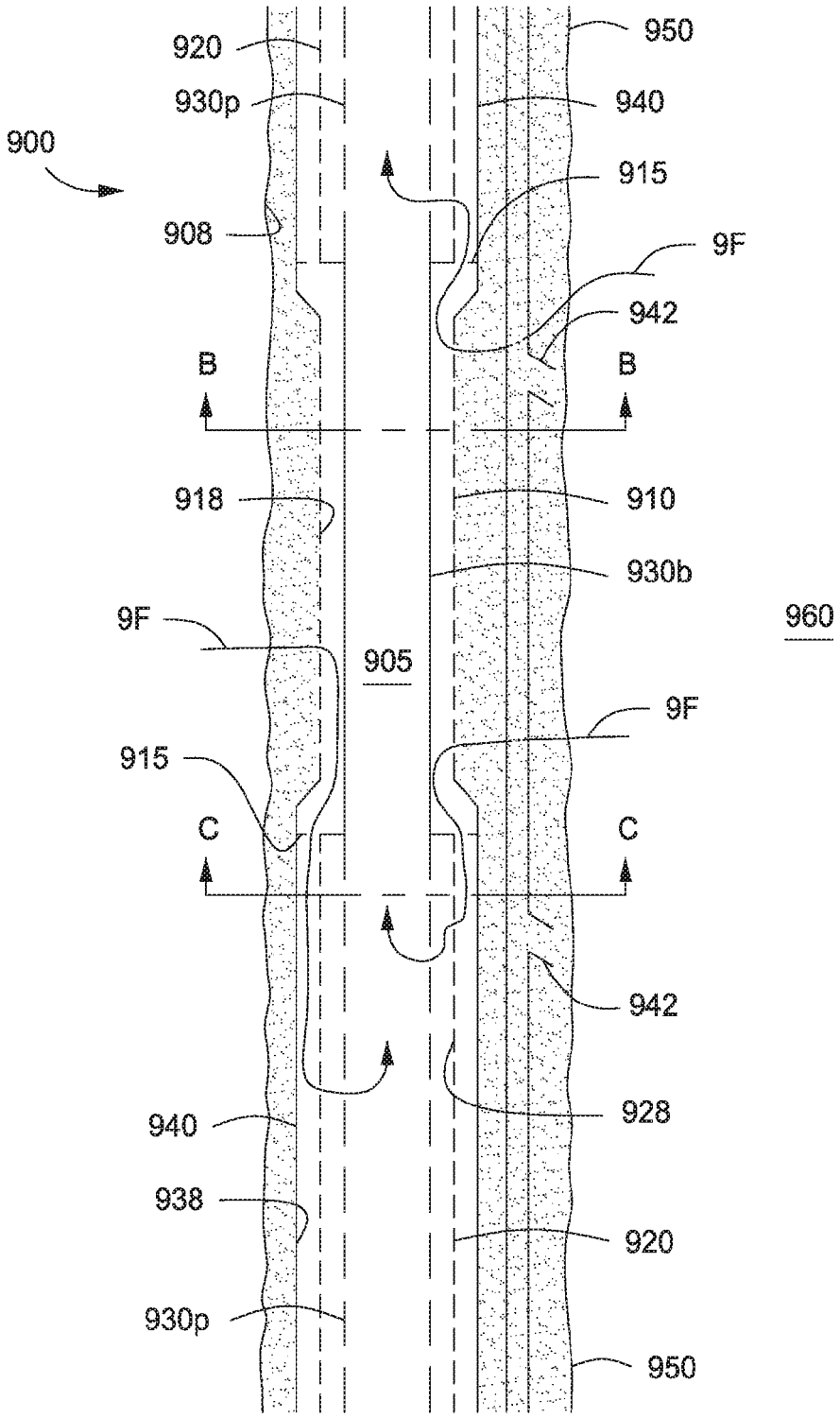
FIGS. 9A through 9C present a side view of a sand screen that may be used as part of a wellbore completion system having alternate flow channels. This screen utilizes primary and secondary permeable sections for filtering fluids downhole.

FIG. 9A provides a side, cross-sectional view of a portion of a sand screen 900, in one embodiment. The sand screen 900 is disposed along an open hole portion of a wellbore 950. The wellbore 950 traverses a subsurface formation 960, with an annulus 908 being formed between the sand screen 900 and the surrounding formation 960.

It can be seen in FIG. 9A that the sand screen 900 has undergone gravel packing. The annulus 908 is shown in spackles, indicating the presence of gravel. The gravel pack provides support for the wellbore 900 along the formation 960 and assists in filtering formation particles during production. Further, the sand screen 900 itself serves to filter formation particles as fluids are produced from the formation 960.

The illustrative screen 900 utilizes concentric conduits to enable the flow of hydrocarbons while further filtering out formation fines. In the arrangement of FIG. 9A, the first conduit is a base pipe (represented by 930*p* and 930*b*); the second conduit is a first filtering conduit 910; the third conduit is a second filtering conduit 920; and a fourth conduit is an outer housing 940.

The base pipe 930 defines an inner bore 905 that receives formation fluids such as hydrocarbon liquids. As shown in FIG. 9A, the base pipe 930 offers alternating permeable and impermeable sections. The permeable sections are shown at 930*p*, while the impermeable sections are shown at 930*b*. The permeable sections 930*p* allow formation fluids to enter the bore 905, while the impermeable sections 930*b* divert formation fluids to the permeable sections 930*p*.

The first filtering conduit 910 is circumferentially disposed about the base pipe 930. More specifically, the first filtering conduit 910 is concentrically arranged around the impermeable section 930*b* of the base pipe.

The second filtering conduit 920 is adjacent to the first filtering conduit 910, and is also circumferentially disposed about the base pipe. More specifically, the second filtering conduit 910 is concentrically arranged around the permeable section 930*p* of the base pipe. In addition, the outer housing 940 is sealingly placed around the second filtering conduit 920.

The filtering conduits 910, 920 contain a filtering medium. The filtering media are designed to retain particles larger than a predetermined size, while allowing fluids to pass through. The filtering media are preferably wire-wrapped screens wherein gaps between two adjacent wires are sized to restrict formation particles larger than a predetermined size from entering the bore 905.

Figure 9B:
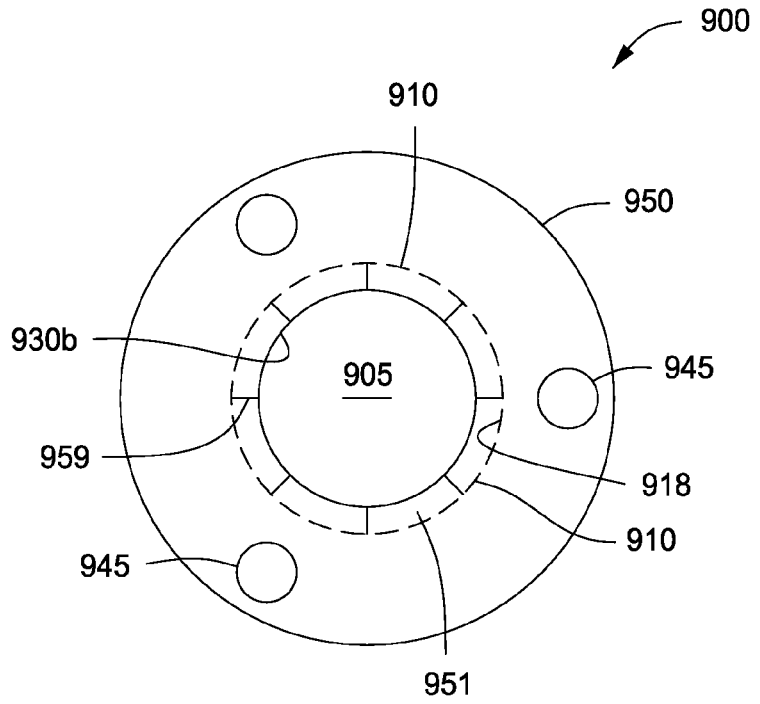
Figure 9C:
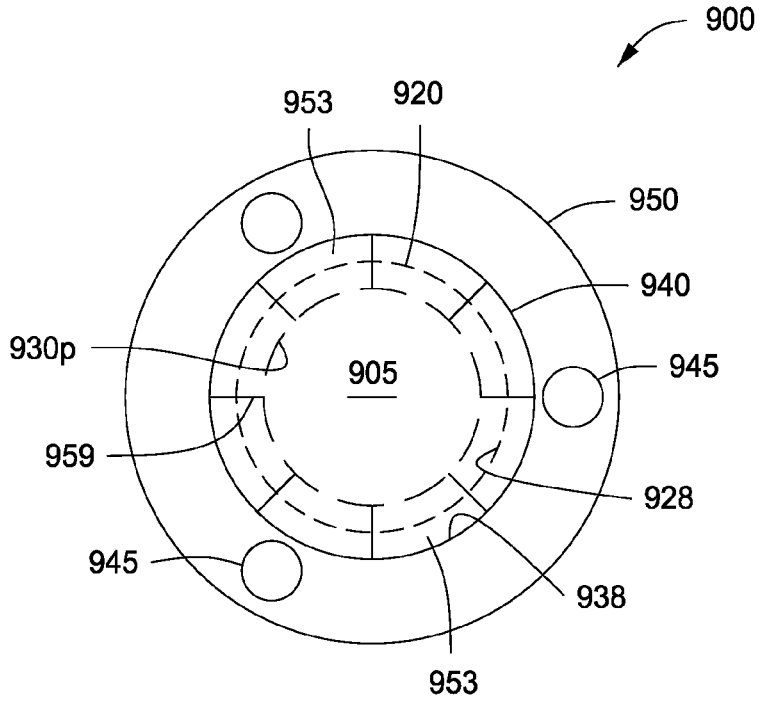

Cross-sectional views of the sand screen 900 are provided in FIGS. 9B and 9C. FIG. 9B is a cross-sectional view taken across line B-B of FIG. 9A, while FIG. 9C is a cross-sectional view taken across line C-C of FIG. 9A. Line B-B is cut across the impermeable or blank section 930*b* of the base pipe, while line C-C is cut across the permeable or slotted section 930*p* of the base pipe.

In FIG. 9B, a first annular region 918 is seen between the base pipe 930*b* and the surrounding first filtering conduit 910. Similarly, in FIG. 9C a second annular region 928 is seen between the base pipe 930*p* and the surrounding second filtering conduit 920. In addition, a third annular region 938 is seen between the second filtering conduit 920 and the surrounding outer housing 940.

Referring back to FIG. 9A, an under-flow ring 915 is placed between the first filtering conduit 910 and the second filtering conduit 920. The under-flow ring 915 directs formation fluids from the first annular region 918 to the third annular region 938. An inner diameter of the outer housing 940 wraps around an outer diameter of the under-flow ring 915 to provide a seal.

It can also be seen in the cross-sectional views of FIGS. 9B and 9C that a series of small tubes are disposed radially around the sand screen 900. These are shunt tubes 945. The shunt tubes 945 connect with alternate flow channels (not shown) to carry gravel slurry along a portion of the wellbore 950 undergoing a gravel packing operation. Nozzles 942 serve as outlets for gravel slurry so as to bypass any sand bridges (not shown) or packer (such as packers 212, 214 of FIG. 2) in the wellbore annulus 908.

The sand screen 900 of FIGS. 9A, 9B and 9C provides a staggered arrangement of filtering media. This causes fluids produced from the formation 960 to be twice filtered. It further provides an engineering redundancy in the event a portion of a filtering medium breaks open. Lines 9F demonstrate the movement of formation fluids into the bore 905 of the base pipe 930*p*.

It can also be seen in the cross-sectional views of FIGS. 9B and 9C that a series of optional walls 959 is provided. The walls 959 are substantially impermeable and serve to create chambers 951, 953 within the conduits 910, 920. Each of the chambers 951, 953 has at least one inlet and at least one outlet. Chambers 951 reside around the first conduit 910, while chambers 953 reside around the second conduit 920. Chambers 951 and 953 are fluidly connected. With or without the walls 959, the chambers 951, 953 are bound by split-rings 305, conduits 910, 920, base pipe 930*b*, under-flow ring 315, and the housing 940. The chambers 951, 953 are adapted to accumulate particles to progressively increase resistance to fluid flow through the chambers 951, 953 in the event a permeable section of a conduit is compromised or impaired and permits formation particles larger then a predetermined size to invade.

When a section of filter medium of the first filtering conduit is breached, sand will enter the annular region 918, continue travelling to the annular region 938, and be retained on the second conduit 920. As the sand accumulates in annular region 938 and starts to fill the chambers 953, the flow resistance in the subject chamber 953 around the second conduit 920 increases. Stated another way, frictional pressure loss in the sand-filled compartment increases, resulting in gradually diminished fluid/sand flow through the first conduit 910 along a compromised chamber 953. Fluid production is then substantially diverted to the first conduits 910 along other compartments. This same "backup system" also works with respect to the second conduit 920 during the injection mode. If a failure occurs in the second conduit 920 such that formation particles pass through the second conduit 920, then a chamber 951 will at least partially be filled with sand. This increases the frictional pressure loss, resulting in gradually diminished fluid/sand flow through a compromised second conduit 920. Fluid production is then substantially diverted to other second conduits 920 along the sand screen 900.

The number of compartments 30A, 30B or the number of chambers 951, 953 along the respective first 910 and second 920 filtering conduits may depend on the length of the completion interval, the production rate, the borehole size for the wellbore 950, and the manufacturing cost. Fewer compartments would enable larger compartment size and result in fewer redundant flow paths if sand infiltrates a chamber 951 or 953. A larger number of chambers 953, 951 may decrease the chamber sizes, increase frictional pressure losses, and reduce well productivity. The operator may choose to adjust the relative sizes and shapes of the chambers 951, 953.

The sand screen 900 provides engineering redundancy for a sand control device. In operation, in the event of a failure in the first filtering conduit 910 or the second filtering conduit 920, sand will begin filling the gap between the first 910 and second 920 filtering conduits, which will in due course block off that part of the screen. Thus, rather than producing sand through a damaged section of screen, the instant invention will tend to block off that section of screen by accumulating debris therein. Thus, the screen of the instant invention can be said to be self-healing to the extent that it tends to block flow through damaged screen sections. Of course, one consequence of this planned blockage is that the well will thereafter be marginally less productive, but that is a small price to pay when the alternative may be to shut down the well and pull the screen for an expensive workover.

Figure 10:
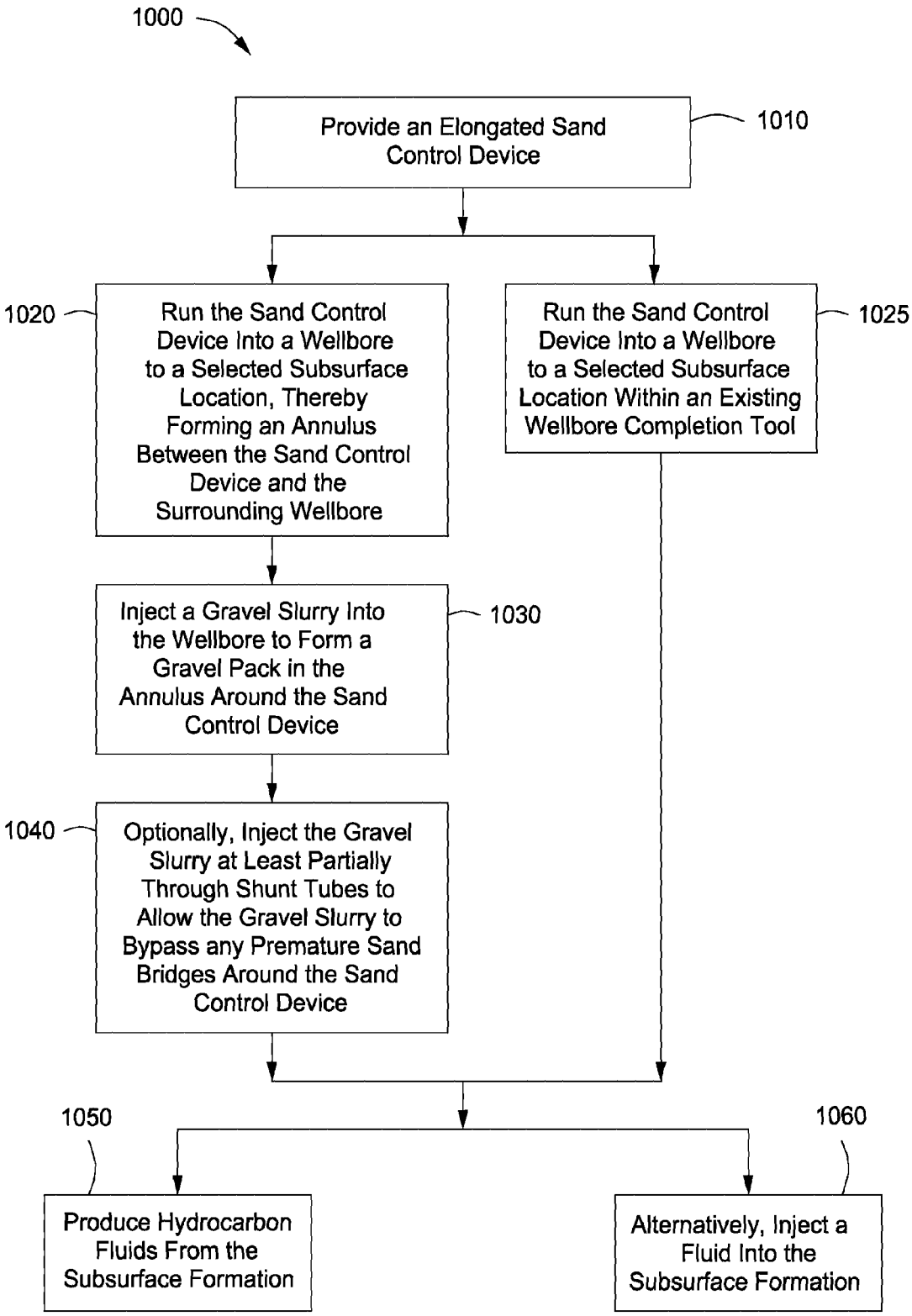
FIG. 10 is a flow chart.

A method for completing a wellbore in a subsurface formation is also provided herein. FIG. 10 provides a flow chart that shows steps for a method 1000 of completing a wellbore using a sand control device, in one embodiment.

The method 1000 first includes providing a sand control device. This is seen at Box 1010. The sand control device is designed in accordance with the sand control joint 300 described above, in its various embodiments. The sand control joint 300 may have one, two, three, or more compartments. In any instance, the base pipe of the sand control device is in fluid communication with a string of production tubing.

The sand control device may be run into a new wellbore as a stand-alone screen. Alternatively, the sand control device may be placed in the wellbore along with a gravel pack. In either instance, the method 1000 also includes running the sand control device into a wellbore. This is shown at Box 1020 of FIG. 10. The sand control device is lowered to a selected subsurface location. The sand control device thereby forms an annulus in the wellbore between the sand control device and the surrounding wellbore.

The method 1000 further includes injecting a gravel slurry into the wellbore. This step is provided at Box 1030. The gravel slurry is injected in order to form a gravel pack in the annulus around the sand control device.

In one aspect, the sand control device comprises at least one shunt tube external to the first filtering conduit and the second filtering conduit. This is shown at Box 1040. The at least one shunt tube runs longitudinally substantially along the first compartment and the second compartment, and provides an alternate flow channel for gravel slurry during the gravel-packing operation. In this instance, the method 1000 further comprises injecting the gravel slurry at least partially through the at least one shunt tube to allow the gravel slurry to bypass any premature sand bridges or any packers around the sand control device so that the wellbore is more uniformly gravel-packed within the annulus.

In an alternative arrangement of the method 1000, the sand control device is run into an existing wellbore. This is shown at Box 1025. In this instance, the sand control device is placed within the inner diameter of an existing completion tool. Such a completion tool may be, for example, a perforated pipe or a previous sand screen.

In one embodiment of the method 1000, the formation fluids comprise hydrocarbon fluids. The method 1000 then further comprises producing hydrocarbon fluids from the subsurface formation. This is seen at Box 1050. Producing hydrocarbon fluids from the subsurface formation means producing hydrocarbons through the filtering medium of the first filtering conduit, along the first annular region, through the under-flow ring, into the third annular region, through the filtering media of the second filtering conduit, into the permeable section of the base pipe, and up the production tubing.

Alternatively, the method 1000 further includes injecting a fluid into the subsurface formation. This is seen at Box 1060. Injecting the fluid into the subsurface formation means injecting an aqueous (or other) fluid into the string of production tubing, and then further injecting the aqueous fluid into the base pipe, through the filtering media of the second filtering conduit, through the under-flow ring, through the filtering media of the first filtering conduit, and into the surrounding subsurface formation.

In another embodiment, the techniques and apparatus provided herein may include a system for producing fluid from a wellbore, the system comprising: providing a wellbore to a subsurface formation comprising a producible fluid; preparing the wellbore to control sand production, by running a sand control device into a wellbore to a selected subsurface location, and thereby forming an annulus in the wellbore between the sand control device and the surrounding wellbore, the sand control device comprising: at least a first compartment, wherein each compartment comprises: a base pipe having a permeable section and an impermeable section, the base pipe being in fluid communication with a string of tubing within the wellbore, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, a blank tubular housing sealingly circumscribing at least the second filtering conduit and forming a third annular region between the second filtering conduit and the surrounding housing, and an under-flow ring disposed between the first filtering conduit and the second filtering conduit and placing the first annular region in fluid communication with the third annular region, and the under-flow ring having an outer diameter that sealingly receives the blank tubular housing at an end; and producing fluid from the wellbore by passing the fluid through at least a portion of the sand control device.

The sand control device may be claimed as follows:

1. A sand control device for restricting the flow of particles within a wellbore, the sand control device comprising:
   at least a first compartment;
   wherein each compartment comprises:
   a base pipe having a permeable section and an impermeable section,
   a first filtering conduit circumscribing the base pipe and forming a first annular region between the base pipe and the first filtering conduit, the first filtering conduit having a filtering medium adjacent the impermeable section of the base pipe,
   a second filtering conduit also circumscribing the base pipe and forming a second annular region between the base pipe and the second filtering conduit, the second filtering conduit having a filtering medium adjacent the permeable section of the base pipe,
   a blank tubular housing circumscribing the second filtering conduit and forming a third annular region between the second filtering conduit and the surrounding housing, and
   an under-flow ring disposed along the base pipe between the first filtering conduit and the second filtering conduit, the under-flow ring placing the first annular region in fluid communication with the third annular region, and the under-flow ring having an outer diameter that sealingly receives the blank tubular housing at an end.
2. The sand control device of sub-paragraph 1, wherein the filtering medium of the first filtering conduit and the filtering medium of the second filtering conduit each comprises a wound wire screen or a wire mesh.
3. The sand control device of sub-paragraph 1, further comprising:
   at least one shunt tube adjacent to the first filtering conduit and the second filtering conduit, the at least one shunt tube running longitudinally along at least the first compartment and providing an alternate flow path for gravel slurry during a gravel-packing operation.
4. The sand control device of sub-paragraph 1, further comprising:
   at least a second compartment.
5. The sand control device of sub-paragraph 1, wherein the under-flow ring comprises:
   a tubular body having an inner diameter and an outer diameter;
   at least two inner ridges radially and equi-distantly spaced about the inner diameter; and
   flow channels between the at least two inner ridges for directing formation fluids.
6. The sand control device of sub-paragraph 5, wherein:
   the flow channels are oriented to direct the flow of production fluids from the first annular region into the third annular region during a production operation.
7. The sand control device of sub-paragraph 6, further comprising:
   a baffle ring disposed between the under-flow ring and the second filtering conduit for circumferentially dispersing fluids as the fluids move from the first annular region to the third annular region; and
   wherein the baffle ring comprises a tubular body having an inner diameter and an outer diameter.
8. The sand control device of sub-paragraph 7, wherein the baffle ring further comprises:
   at least two outer baffles radially and equi-distantly spaced about the outer diameter; and
   flow channels between the at least two outer baffles for dispersing formation fluids.
9. The sand control device of sub-paragraph 7, wherein the baffle ring further comprises:
   an inner shoulder; and
   a plurality of fluid distribution ports placed radially and equi-distantly around the inner shoulder, with the fluid distribution ports being configured to receive formation fluids from the under-flow ring and deliver the formation fluids into the third annular region.

10. The sand control device of sub-paragraph 6, further comprising:
a section of blank pipe disposed between the under-flow ring and the second filtering conduit for permitting a radial dispersion of fluids as the fluids move from the first annular region to the third annular region; and
wherein the housing also circumscribes the section of blank pipe.

11. The sand control device of sub-paragraph 5, wherein:
the flow channels are oriented to direct the flow of injection fluids from the third annular region into the first annular region during an injection operation.

12. The sand control device of sub-paragraph 1, further comprising:
at least one wall disposed inside (i) the first annular region, (ii) the third annular region, or (iii) both, to form at least one chamber in (i) the first annular region, (ii) the third annular region, or (iii) both;
wherein the chamber has at least one inlet and at least one outlet; and wherein the at least one chamber is adapted to accumulate particles in the chamber to progressively increase resistance to fluid flow through the chamber in the event the at least one inlet is impaired and allows particles larger then a predetermined size to pass into the chamber.

13. A method for completing a wellbore in a subsurface formation, the method comprising:
providing a sand control device, the sand control device comprising:
at least a first compartment;
wherein each compartment comprises:
a base pipe having a permeable section and an impermeable section, the base pipe being in fluid communication with a string of tubing within the wellbore,
a first filtering conduit circumscribing the base pipe and forming a first annular region between the base pipe and the first filtering conduit, the first filtering conduit having a filtering medium adjacent the impermeable section of the base pipe,
a second filtering conduit also circumscribing the base pipe and forming a second annular region between the base pipe and the second filtering conduit, the second filtering conduit having a filtering medium adjacent the permeable section of the base pipe,
a blank tubular housing sealingly circumscribing at least the second filtering conduit and forming a third annular region between the second filtering conduit and the surrounding housing, and
an under-flow ring disposed between the first filtering conduit and the second filtering conduit and placing the first annular region in fluid communication with the third annular region, and the under-flow ring having an outer diameter that sealingly receives the blank tubular housing at an end; and
running the sand control device into a wellbore to a selected subsurface location, and thereby forming an annulus in the wellbore between the sand control device and the surrounding wellbore.

14. The method of sub-paragraph 13, further comprising:
injecting a gravel slurry into the wellbore in order to form a gravel pack around the sand control device and within the annulus.

15. The method of sub-paragraph 13, wherein the at least a first compartment comprises at least a first compartment and a second compartment.

16. The method of sub-paragraph 13, wherein the filtering medium of the first filtering conduit and the filtering medium of the second filtering conduit each comprises a wound wire screen or a wire mesh.

17. The method of sub-paragraph 14, wherein:
the sand control device further comprises at least one shunt tube adjacent to the first filtering conduit, the second filtering conduit, and the housing, the at least one shunt tube running longitudinally substantially along the first compartment and providing an alternate flow path for gravel slurry during the gravel-packing operation; and
the method further comprises:
injecting the gravel slurry at least partially through the at least one shunt tube to allow the gravel slurry to bypass any premature sand bridges around the sand control device so that the wellbore is more uniformly gravel-packed within the annulus around the sand control device.

18. The method of sub-paragraph 13, wherein:
the tubing is a string of production tubing such that the base pipe is in fluid communication with a string of production tubing;
the flow channels of the under-flow ring are oriented to direct the flow of production fluids from the first annular region into the third annular region during a production operation;
the formation fluids comprise hydrocarbon fluids; and
the method further comprises:
producing hydrocarbon fluids from the subsurface formation, through the filtering medium of the first filtering conduit, along the first annular region, through the under-flow ring, into the third annular region, through the filtering media of the second filtering conduit, into the second annular region, through the permeable section of the base pipe, and up the production tubing.

19. The method of sub-paragraph 18, wherein the sand control device further comprises:
a baffle ring disposed between the under-flow ring and the second filtering conduit for circumferentially dispersing fluids as the fluids move from the first annular region to the third annular region.

20. The method of sub-paragraph 13, wherein:
the base pipe is in fluid communication with a string of injection tubing; and
the flow channels of the under-flow ring are oriented to direct the flow of injection fluids from the third annular region into the first annular region during a fluid injection operation.

21. The method of sub-paragraph 20, further comprising:
injecting a fluid into the production tubing; and
further injecting the fluid into the base pipe, through the filtering media of the second filtering conduit, into the third annular region, through the under-flow ring, into the first annular region, through the filtering media of the first filtering conduit, and into the surrounding subsurface formation.

22. The method of sub-paragraph 13, further comprising:
running the at least a first compartment into an inner diameter of a completion tool of a previously-completed wellbore.

23. A system for producing fluid from a wellbore, the system comprising:

providing a wellbore to a subsurface formation comprising a producible fluid;

preparing the wellbore to control sand production, by running a sand control device into a wellbore to a selected subsurface location, and thereby forming an annulus in the wellbore between the sand control device and the surrounding wellbore, the sand control device comprising:

at least a first compartment, wherein each compartment comprises:

a base pipe having a permeable section and an impermeable section, the base pipe being in fluid communication with a string of tubing within the wellbore, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, a blank tubular housing sealingly circumscribing at least the second filtering conduit and forming a third annular region between the second filtering conduit and the surrounding housing, and an under-flow ring disposed between the first filtering conduit and the second filtering conduit and placing the first annular region in fluid communication with the third annular region, and the under-flow ring having an outer diameter that sealingly receives the blank tubular housing at an end; and producing fluid from the wellbore by passing the fluid through at least a portion of the sand control device.

While it will be apparent that the inventions herein described are well calculated to achieve the benefits and advantages set forth above, it will be appreciated that the inventions are susceptible to modification, variation and change without departing from the spirit thereof. An improved sand control device is provided for restricting the flow of particles from a subsurface formation into a tubular body within a wellbore.

What is claimed is:

1. A sand control device for restricting the flow of particles within a wellbore, the sand control device comprising:

at least a first compartment, wherein each compartment comprises:

a base pipe having a permeable section and an impermeable section, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, wherein the filtering medium of the first filtering conduit and the filtering medium of the second filtering conduit each comprises a wound wire screen or a wire mesh, a blank tubular housing circumscribing the second filtering conduit and forming a third annular region between the second filtering conduit and the surrounding housing, and an under-flow ring disposed along the base pipe between the first filtering conduit and the second filtering conduit, the under-flow ring placing the first annular region in fluid communication with the third annular region, and the under-flow ring having an outer diameter that sealingly receives the blank tubular housing at an end.

2. The sand control device of claim 1, wherein the first filtering conduit and the second filtering conduit are each substantially concentrically placed around the base pipe.

3. The sand control device of claim 1, further comprising:

at least a second compartment.

4. The sand control device of claim 3, further comprising:

at least one shunt tube adjacent to the first filtering conduit and the second filtering conduit, the at least one shunt tube running longitudinally substantially along the first compartment and the second compartment and providing an alternate flow path for gravel slurry during a gravel-packing operation.

5. The sand control device of claim 3, wherein each compartment is between about 5 feet (1.52 meters) and 40 feet (12.19 meters) in length.

6. The sand control device of claim 1, wherein the under-flow ring comprises:

a tubular body having an inner diameter and an outer diameter;

at least two inner ridges radially and equi-distantly spaced about the inner diameter; and flow channels between the at least two inner ridges for directing formation fluids.

7. The sand control device of claim 6, wherein:

the flow channels are oriented to direct the flow of production fluids from the first annular region into the third annular region during a production operation.

8. The sand control device of claim 7, further comprising:

a baffle ring disposed between the under-flow ring and the second filtering conduit for circumferentially dispersing fluids as the fluids move from the first annular region to the third annular region; and wherein the baffle ring comprises a tubular body having an inner diameter and an outer diameter.

9. The sand control device of claim 8, wherein the baffle ring further comprises:

at least two outer baffles radially and equi-distantly spaced about the outer diameter; and flow channels between the at least two outer baffles for dispersing formation fluids.

10. The sand control device of claim 8, wherein the baffle ring further comprises:

an inner shoulder; and a plurality of fluid distribution ports placed radially and equi-distantly around the inner shoulder, with the fluid distribution ports being configured to receive formation fluids from the under-flow ring and deliver the formation fluids into the third annular region.

11. The sand control device of claim 7, further comprising:

a section of blank pipe disposed between the under-flow ring and the second filtering conduit for permitting a circumferential dispersion of fluids as the fluids move from the first annular region to the third annular region; and wherein the housing also circumscribes the section of blank pipe.

12. The sand control device of claim 8, wherein the at least one permeable section of the base pipe comprises (i) circular holes, (ii) slots, (iii) a wound screen, or (iv) combinations thereof for receiving formation fluids from the second filtering conduit.

13. The sand control device of claim 8, wherein:

the first filtering conduit comprises a first end and a second end;

the first annular region in the first compartment is sealed at the first end; and an under-flow ring is placed along the first filtering conduit at the second end.

14. The sand control device of claim 8, wherein:

the second filtering conduit comprises a first end proximal to the first filtering conduit, and a second end distal to the first filtering conduit; and an under-flow ring is placed proximate the first end of the second filtering conduit.

15. The sand control device of claim 14, wherein:

the second and third annular regions in the first compartment are sealed at the second end of the second filtering conduit; and the blank tubular housing circumscribing the second filtering conduit is also sealed at the second end of the second filtering conduit.

16. The sand control device of claim 6, wherein:

the flow channels are oriented to direct the flow of injection fluids from the third annular region into the first annular region during an injection operation.

17. The sand control device of claim 1, wherein the sand control device is between about 10 feet (3.05 meters) and 40 feet (12.19 meters) in length.

18. The sand control device of claim 1, further comprising:

at least one wall disposed inside (i) the first annular region, (ii) the third annular region, or (iii) both, to form at least one chamber in (i) the first annular region, (ii) the third annular region, or (iii) both;

wherein the chamber has at least one inlet and at least one outlet; and wherein the at least one chamber is adapted to accumulate particles in the chamber to progressively increase resistance to fluid flow through the chamber in the event the at least one inlet is impaired and allows particles larger than a predetermined size to pass into the chamber.

19. A method for completing a wellbore in a subsurface formation, the method comprising:

providing a sand control device, the sand control device comprising:

at least a first compartment, wherein each compartment comprises:

a base pipe having a permeable section and an impermeable section, the base pipe being in fluid communication with a string of tubing within the well bore, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, wherein the filtering medium of the first filtering conduit and the filtering medium of the second filtering conduit each comprises a wound wire screen or a wire mesh, a blank tubular housing circumscribing at least the second filtering conduit and forming a third annular region between the second filtering conduit and the surrounding housing, and an under-flow ring disposed between the first filtering conduit and the second filtering conduit and placing the first annular region in fluid communication with the third annular region, and the under-flow ring having an outer diameter that sealingly receives the blank tubular housing at an end; and running the sand control device into a wellbore to a selected subsurface location, and thereby forming an annulus in the wellbore between the sand control device and the surrounding wellbore.

20. The method of claim 19, further comprising:

running the at least a first compartment into an inner diameter of a completion tool of a previously-completed wellbore.

21. The method of claim 20, wherein the completion tool is a perforated pipe or a sand control device.

22. The method of claim 19, further comprising:

injecting a gravel slurry into the wellbore in order to form a gravel pack around the sand control device and within the annulus.

23. The method of claim 19, wherein the filtering medium of the first filtering conduit and the filtering medium of the second filtering conduit each comprises a wound wire screen or a wire mesh.

24. The method of claim 19, wherein the at least a first compartment comprises at least a first compartment and a second compartment.

25. The method of claim 24, wherein each compartment is between about 5 feet (1.52 meters) and 40 feet (12.19 meters) in length.

26. The method of claim 19, wherein:

the sand control device further comprises at least one shunt tube adjacent to the first filtering conduit, the second filtering conduit, and the housing, the at least one shunt tube running longitudinally substantially along the first compartment and providing an alternate flow path for gravel slurry during the gravel-packing operation; and the method further comprises:

injecting the gravel slurry at least partially through the at least one shunt tube to allow the gravel slurry to bypass any premature sand bridges or packers around the sand control device so that the wellbore is more uniformly gravel-packed within the annulus around the sand control device.

27. The method of claim 19, wherein the under-flow ring comprises:

a tubular body having an inner diameter and an outer diameter;

at least two inner ridges radially and equi-distantly spaced about the inner diameter; and flow channels between the at least two inner ridges for directing formation fluids.

28. The method of claim 19, wherein:

the tubing is a string of production tubing such that the base pipe is in fluid communication with a string of production tubing; and the flow channels of the under-flow ring are oriented to direct the flow of production fluids from the first annular region into the third annular region during a production operation.

29. The method of claim 28, wherein:

the formation fluids comprise hydrocarbon fluids; and the method further comprises:

producing hydrocarbon fluids from the subsurface formation, through the filtering medium of the first filtering conduit, along the first annular region, through the under-flow ring, into the third annular region, through the filtering media of the second filtering conduit, into the second annular region, through the permeable section of the base pipe, and up the production tubing.

30. The method of claim 29, wherein the sand control device further comprises:

a baffle ring disposed between the under-flow ring and the second filtering conduit for dispersing fluids as the fluids move from the first annular region to the third annular region.

31. The method of claim 30, wherein the baffle ring comprises:

a tubular body having an inner diameter and an outer diameter;

at least two outer baffles radially and equi-distantly spaced about the outer diameter; and flow channels between the at least two outer baffles for dispersing formation fluids.

32. The method of claim 29, wherein the sand control device further comprises:

a section of blank pipe disposed between the under-flow ring and the second filtering conduit for permitting a circumferential dispersion of fluids as the fluids move from the first annular region to the third annular region; and wherein the housing also circumscribes the section of blank pipe.

33. The method of claim 19, wherein the sand control device is between about 10 feet (3.05 meters) and 40 feet (12.19 meters) in length.

34. The method of claim 19, wherein the at least one permeable section of the base pipe comprises (i) circular holes, (ii) slots, (iii) a wound screen, (iv) a wire mesh, or (v) combinations thereof for receiving formation fluids from the second filtering conduit.

35. The method of claim 34, wherein:

the first filtering conduit comprises a first end and a second end;

the first annular region in the first compartment is sealed at the first end; and an under-flow ring is placed along the first filtering conduit at the second end.

36. The method of claim 34, wherein:

the second filtering conduit comprises a first end proximal to the first filtering conduit, and a second end distal to the first filtering conduit; and an under-flow ring is placed proximate the first end of the second filtering conduit.

37. The method of claim 36, wherein:

the second and third annular regions in the first compartment are sealed at the second end of the second filtering conduit; and the blank tubular housing circumscribing the second filtering conduit is also sealed at the second end of the second filtering conduit.

38. The method of claim 19, wherein:

the tubing is a string of injection tubing such that the base pipe is in fluid communication with a string of injection tubing; and the flow channels of the under-flow ring are oriented to direct the flow of injection fluids from the third annular region into the first annular region during a fluid injection operation.

39. The method of claim 38, further comprising:

injecting a fluid into the tubing; and further injecting the fluid into the base pipe, into the second annular region, through the filtering media of the second filtering conduit, into the third annular region, through the under-flow ring, into the first annular region, through the filtering media of the first filtering conduit, and into the surrounding subsurface formation.

40. A system for producing fluid from a wellbore, the system comprising:

providing a wellbore to a subsurface formation comprising a producible fluid;

preparing the wellbore to control sand production, by running a sand control device into a wellbore to a selected subsurface location, and thereby forming an annulus in the wellbore between the sand control device and the surrounding wellbore, the sand control device comprising:

at least a first compartment, wherein each compartment comprises:

a base pipe having a permeable section and an impermeable section, the base pipe being in fluid communication with a string of tubing within the well bore, a first filtering conduit circumscribing the base pipe and forming a first annular region between the base pipe and the first filtering conduit, the first filtering conduit having a filtering medium adjacent the impermeable section of the base pipe, a second filtering conduit also circumscribing the base pipe and forming a second annular region between the base pipe and the second filtering conduit, the second filtering conduit having a filtering medium adjacent the permeable section of the base pipe, wherein the filtering medium of the first filtering conduit and the filtering medium of the second filtering conduit each comprises a wound wire screen or a wire mesh, a blank tubular housing circumscribing at least the second filtering conduit and forming a third annular region between the second filtering conduit and the surrounding housing, and an under-flow ring disposed between the first filtering conduit and the second filtering conduit and placing the first annular region in fluid communication with the third annular region, and the under-flow ring having an outer diameter that sealingly receives the blank tubular housing at an end; and producing fluid from the wellbore by passing the fluid through at least a portion of the sand control device.

* * * * *